US007771323B1

(12) United States Patent
Batca

(10) Patent No.: US 7,771,323 B1
(45) Date of Patent: Aug. 10, 2010

(54) FOLD AWAY WRIST ROLLER WITH CONNECTABLE FLEXIBLE LINE

(76) Inventor: Roger Batca, 3102 Shaftsbury St., Durham, NC (US) 27704

( * ) Notice: Subject to any disclaimer, the term of this patent is extended or adjusted under 35 U.S.C. 154(b) by 0 days.

(21) Appl. No.: 12/408,982

(22) Filed: Mar. 23, 2009

Related U.S. Application Data

(60) Provisional application No. 61/070,536, filed on Mar. 24, 2008.

(51) Int. Cl.
*A63B 23/04* (2006.01)
*A63B 23/14* (2006.01)
*A63B 21/062* (2006.01)

(52) U.S. Cl. ..... 482/46; 482/100; 482/137; 482/138; 482/142

(58) Field of Classification Search ..... 482/44–46, 482/49, 50, 92–94, 97–103, 133–139, 142
See application file for complete search history.

(56) References Cited

U.S. PATENT DOCUMENTS

| | | | | |
|---|---|---|---|---|
| 4,072,308 | A * | 2/1978 | Applegate | 482/94 |
| 4,183,520 | A * | 1/1980 | Chase | 482/112 |
| 4,564,193 | A * | 1/1986 | Stewart | 482/60 |
| 4,598,908 | A * | 7/1986 | Morgan | 482/138 |
| 4,606,540 | A * | 8/1986 | Chin-Sen | 482/98 |
| 4,678,185 | A * | 7/1987 | Mahnke | 482/137 |
| 4,979,734 | A * | 12/1990 | Sims | 482/112 |
| 5,967,949 | A * | 10/1999 | Davenport | 482/93 |
| 6,019,704 | A * | 2/2000 | Morgan | 482/46 |
| 6,319,178 | B1 * | 11/2001 | Webber | 482/100 |
| 6,659,919 | B2 * | 12/2003 | Deola | 482/99 |
| 7,172,537 | B2 * | 2/2007 | Eisa | 482/138 |
| 7,563,207 | B1 * | 7/2009 | Burek | 482/91 |
| 7,604,576 | B2 * | 10/2009 | Drechsler | 482/99 |
| 2004/0009856 | A1 * | 1/2004 | Hammer | 482/99 |
| 2006/0189462 | A1 * | 8/2006 | Pearson et al. | 482/142 |
| 2006/0258517 | A1 * | 11/2006 | Ashley | 482/94 |
| 2010/0016129 | A1 * | 1/2010 | Chou | 482/97 |

FOREIGN PATENT DOCUMENTS

| | | | |
|---|---|---|---|
| CA | 2464984 | A1 * | 10/2005 |
| DE | 102006002548 | A1 * | 10/2006 |
| FR | 2474875 | A * | 8/1981 |
| RU | 2069579 | C1 * | 11/1996 |
| SU | 1683790 | A1 * | 10/1991 |
| SU | 1720666 | A1 * | 3/1992 |

* cited by examiner

*Primary Examiner*—Loan H Thanh
*Assistant Examiner*—Victor K Hwang
(74) *Attorney, Agent, or Firm*—Coats & Bennett, P.L.L.C.

(57) ABSTRACT

An exercise apparatus includes a leg exercise arm assembly pivotally attached to a frame or user support assembly. A user can perform leg extension exercises and leg curl exercises with the leg exercise arm assembly. The exercise apparatus also includes a wrist roller assembly that is also pivotally attached to the user support assembly, frame, or leg exercise arm assembly. The wrist roller assembly can be locked into at least one storage position that allows a user to perform leg extension and leg curl exercises without interference from the wrist roller assembly and locked into at least one use position that allows a user to perform wrist rolling exercises. The wrist roller assembly includes a flexible line that can be connected to a high station free flexible line end, a mid section free flexible line end, or a low section free flexible line end based on the ratio of resistance desired.

18 Claims, 26 Drawing Sheets

FOLD AWAY WRIST ROLLER WITH CONNECTABLE FLEXIBLE LINE

RELATED APPLICATIONS

This application claims priority to Provisional Patent Application No. 61/070,536 filed Mar. 24, 2008, which is incorporated herein by reference.

FIELD OF THE INVENTION

The present invention is directed generally to exercise equipment and, more particularly, an apparatus to perform leg exercises and wrist rolling exercises.

BACKGROUND

Various types of exercise machines for strengthening and conditioning the body are known. One group of exercise machines are categorized as multi station gyms. Multi station gyms combine multiple exercise stations onto one frame, typically sharing one user support seat, in order to save space and cost. Also, most multi station gyms typically have one resistance source shared by all the stations to further save cost. The resistance source is usually a weight stack wherein a cable system interconnects all the exercise stations to the weight stack. Since all the exercise stations share the same frame and typically the same resistance source, the exercise stations will be close to one another and must cooperatively work with one another wherein the exercise movement of one station will not interfere with the movement of another exercise station. A properly designed multi station gym will also allow the user to properly position their self to perform each exercise without interference from any of the unused stations.

One common design of a multi station gym includes a user support bottom seat and back seat near the front of the gym and a weight stack near the back of the gym. This common design also includes a high pull station above the user support seating, a vertical pressing station just below the high pull station, a mid section free cable end to pull just above and behind the seating for performing abdominal crunches, a leg extension/leg curl station in front of the user seating, and a low section free cable end to pull which exits near the bottom of the leg extension/leg curl station. To use the high pull down station, the user pulls down one or two free cables to exercise the back, bicep, and triceps muscles. To use the pressing station, the user presses one or two arms outward to exercise the chest muscles. To use the mid section free cable, the user attaches an abdominal crunch strap to the free cable and performs abdominal crunches to exercise the abdominal muscles. To use the leg extension station, the user sits in the seat and puts their knees over an upper pad assembly and their ankles behind a lower pad assembly and performs extensions to exercise the thigh muscles. To use the leg curl station, the user adjusts the upper pad assembly above the leg extension/curl arm assembly pivot point in order to brace their leg just above their knee while facing the gym. The user then aligns their knee with the leg extension/curl arm assembly pivot point and places their ankle behind the lower pad assembly and performs standing leg curls to exercise the hamstring muscles. To use the low section free cable end, the user usually attaches a curl bar to perform bicep curls. The combined stations allow the user to exercise their chest, back, upper arms, abdominal muscles, and legs. However, this compact design does not include an effective way to isolate and exercise the forearm muscles.

A known type of exercise apparatus to effectively isolate and exercise the forearms is a wrist rolling apparatus. A wrist rolling apparatus typically has a handle bar attached to a frame wherein a flexible line is connected at one end to the handle bar and wherein the other end is connected to resistance. To exercise the forearm muscles, a user will grasp the handle bar and roll their wrist forward or backwards wherein the handle bar will rotate on the frame in order to wrap the flexible line around the handle bar which will displace the resistance element and provide resistance.

It would be desirable for a multi station gym design to include a wrist rolling assembly wherein a user could effectively isolate and exercise their forearms. It would also be desirable to add the wrist roller assembly by minimally changing the compact size of the gym and by sharing the existing frame. It would also be desirable to add the wrist roller assembly to the gym wherein the user's movement and position while exercising with one station would not interfere with the user's movement and position while exercising with another station. It would also be desirable to add the wrist rolling assembly without adding an additional cable to the permanent cable system which would add extra cable stretch and cable bounce, and negatively affect the performance of the exercise stations.

SUMMARY

The present invention is an exercise apparatus which includes a leg exercise assembly and a wrist rolling assembly. The leg exercise assembly and wrist rolling assembly cooperatively work in tandem wherein the wrist rolling assembly is locked into a first storage position onto the leg exercise assembly wherein the wrist roller assembly pivots along with the leg exercise assembly during leg extension and leg curl exercises. This allows the user to perform leg extension and leg curl exercises without interference from the wrist rolling assembly. The exercise apparatus comprises a frame, a resistance element, and in one exemplary embodiment, an arm assembly, a high pull station, a mid pull station, a low pull station, and a leg exercise arm assembly along with a wrist rolling assembly pivotally attached to the frame wherein a flexible connecting line and pulley system interconnects the leg exercise arm assembly, the arm assembly, the high pull station, the mid pull station, and the low pull station to the resistance element.

In another aspect of the invention, the wrist rolling assembly can be adjusted to a second position wherein the wrist rolling assembly works in tandem with the high pull station, the mid pull station, or the low pull station. A flexible line on the wrist rolling assembly can be connected to a free flexible line end within the high pull station, or a free flexible line end within the mid pull station, or a free flexible line end within the low pull station wherein wrist rolling exercises can be performed. The free flexible line ends may be interconnected with the resistance element wherein one free flexible line end provides an alternate ratio of resistance than another when pulled, thus allowing the user to connect the wrist roller flexible line to the free flexible line end with the desired ratio of resistance.

In an alternate embodiment, the leg exercise arm assembly is pivotally attached to the frame and the wrist rolling assembly is pivotally attached to the leg exercise arm assembly. As in the previous embodiment, the leg exercise assembly and wrist rolling assembly cooperatively work in tandem wherein the wrist rolling assembly is locked into a first storage position onto the leg exercise assembly wherein the wrist roller assembly pivots along with the leg exercise assembly during leg extension and leg curl exercises. This allows the user to perform leg extension and leg curl exercises without interference from the wrist rolling assembly.

In another alternate embodiment, a wrist roller assembly is pivotally attached to the frame and can be locked into a storage first position on the frame which allows the user to perform chest press, mid row, high pull, and mid pull exercises without interference from the wrist roller assembly. The wrist roller assembly can also be pivotally adjusted and locked into a storage second position on the frame which allows the user to perform leg extension and leg curl exercises without interference from the wrist roller assembly. The wrist roller assembly can also be pivotally adjusted and locked into a use third position wherein a flexible line on the wrist rolling assembly can be connected to a free flexible line end within the high pull station, or a free flexible line end within the mid pull station, or a free flexible line end within the low pull station wherein wrist rolling exercises can be performed.

Other aspects of the invention will become apparent in the detailed description.

DETAILED DESCRIPTION

Figure 1:
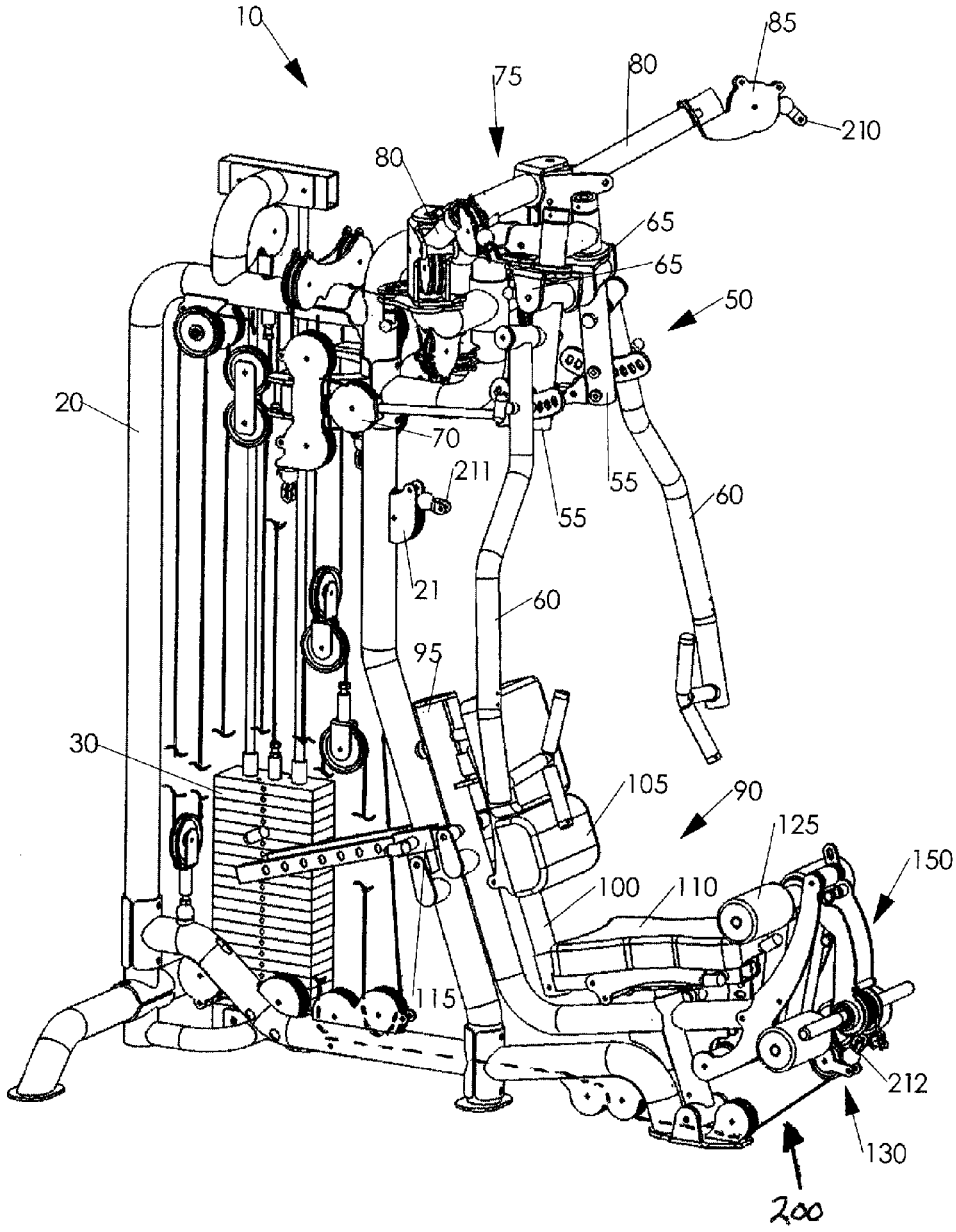
FIG. 1 is a perspective view illustrating an exemplary exercise apparatus from the front right side wherein the leg exercise arm assembly is in a start position and the wrist roller assembly is in a stored first position.
Figure 1:
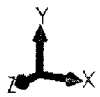

Referring now to the drawings, an exercise apparatus according to the present invention is shown therein and indicated generally by the numeral 10. The exercise apparatus 10 comprises a frame 20, weight stack 30 or other resistance element, arm assembly 50, adjustable width high pull down assembly 75, user support assembly 90, a leg exercise arm assembly 130, 230, 330, a wrist roller assembly 150, 250, 350, and a flexible line connecting system 200, including free flexible line ends 210, 211, and 212, interconnecting the arm assembly 50, adjustable width high pull down assembly 75, and leg exercise arm assembly 130, 230, 330 to the resistance element 30. The exemplary embodiment shown in the drawings is for performing chest press exercises, mid row exercises, high pull down exercises, leg extension exercises, leg curl exercises, and wrist rolling exercises. In the exemplary embodiment, the flexible line connecting system 200 is a cable and pulley system. A cable and pulley system with a similar configuration is described in more detail in U.S. patent application Ser. No. 11/763,509 wherein Roger Batca is the inventor. Those skilled in the art would appreciate that other flexible lines such as belts, straps, chains, ropes, or cords could be used to carry out the present invention. Also, those skilled in the art would appreciate that there are numerous configurations of cables and pulleys that could be used to carry out the present invention.

As illustrated in FIGS. 1-7, the frame 20 provides structural support and stability to the exercise apparatus 10. The frame 20 also provides connection points for the resistance element 30, arm assembly 50, adjustable width high pull down assembly 75, user support assembly 90, leg exercise arm assembly 130, wrist roller assembly 150, and pulleys within cable and pulley system 200. The frame 20 also includes frame plates 21 which house a pulley within cable and pulley system 200 wherein a free cable end 211 exits the frame to provide a mid section pulling station.

As illustrated in FIGS. 1-7, in the exemplary embodiment, the resistance element 30 is a weight stack. Weight stacks are commonly used as a resistance element in the art of strength training. Those skilled in the art will appreciate that other resistance devices, such as electronic resistance devices, magnetic breaks, hydraulic cylinders, elastic bands, free weights, or pneumatic resistance may also be used to practice the present invention.

As illustrated in FIGS. 1-7, the arm assembly 50 includes respective first arm sections 55 pivotally attached to respective swivel assemblies 65. The swivel assemblies 65 are pivotally attached to the frame 20. The arm assembly 50 also includes respective second arm sections 60 which are pivotally attached to respective first arm sections 55. A respective pulley assembly 70 is pivotally attached to a respective first arm section 55 and interconnects the arm assembly 50 with the weight stack 30 by way of cable and pulley system 200. A two axis arm assembly with similar components is described in more detail in U.S. patent application Ser. Nos. 11/254,576 and 11/346,528 and 11/584,327 wherein Roger Batca is the inventor.

As illustrated in FIGS. 1-7, the adjustable width high pull down assembly 75 includes respective arm extensions 80 that are pivotally attached to frame 20 and are width adjustable. Respective swivel pulley assemblies 85 are pivotally attached at the distal end of each respective arm extension 80. A respective free cable end 210 exits a respective swivel pulley assembly 85 wherein a handle assembly or other assembly can be attached. An adjustable width high pull down assembly with similar components is described in more detail in U.S. patent application Ser. No. 11/763,509 wherein Roger Batca is the inventor.

As illustrated in FIGS. 1-8 the user support assembly 90 includes a seat main frame 95, a seat sub frame 100, a back seat assembly 105, a bottom seat assembly 110, an upper pad assembly 125, a leg exercise arm assembly 130, and a wrist roller assembly 150. The user support assembly 90 also includes adjustment mechanism 115 to adjust the user support assembly 90 to various locations to support the user for various exercises. Seat main frame 95 includes aperture plate 97 which secures wrist roller assembly 150 into a use second position.

Figure 8:
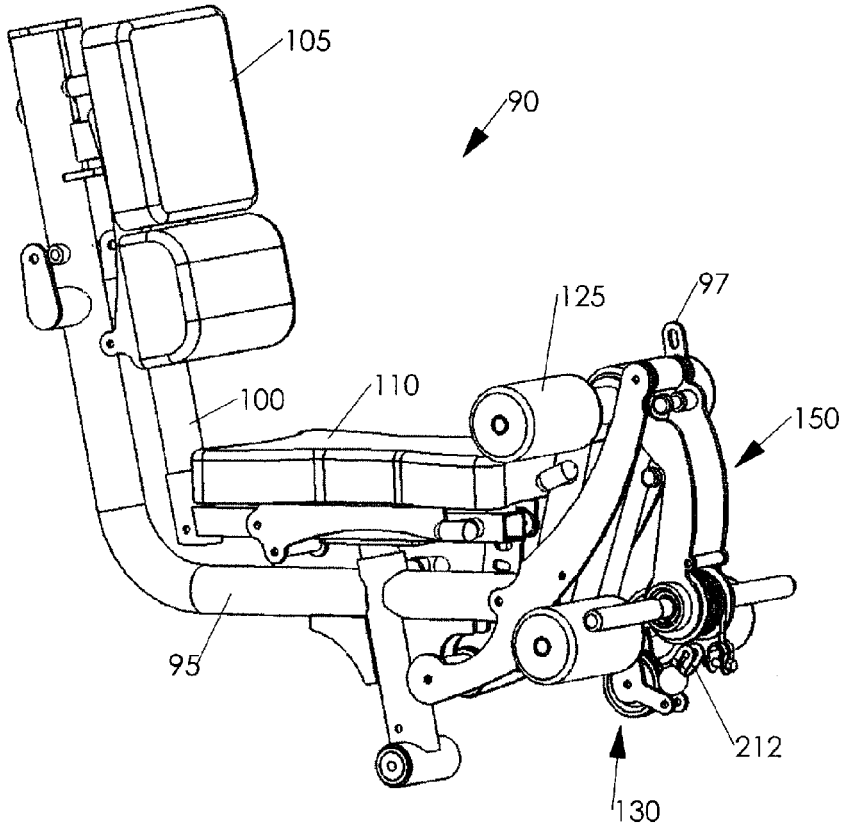
FIG. 8 is a perspective view illustrating an exemplary user support assembly from the front right side wherein the leg exercise arm assembly is in a start position and the wrist roller assembly is locked into a storage first position.
Figure 8:
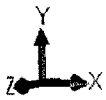
Figure 12:
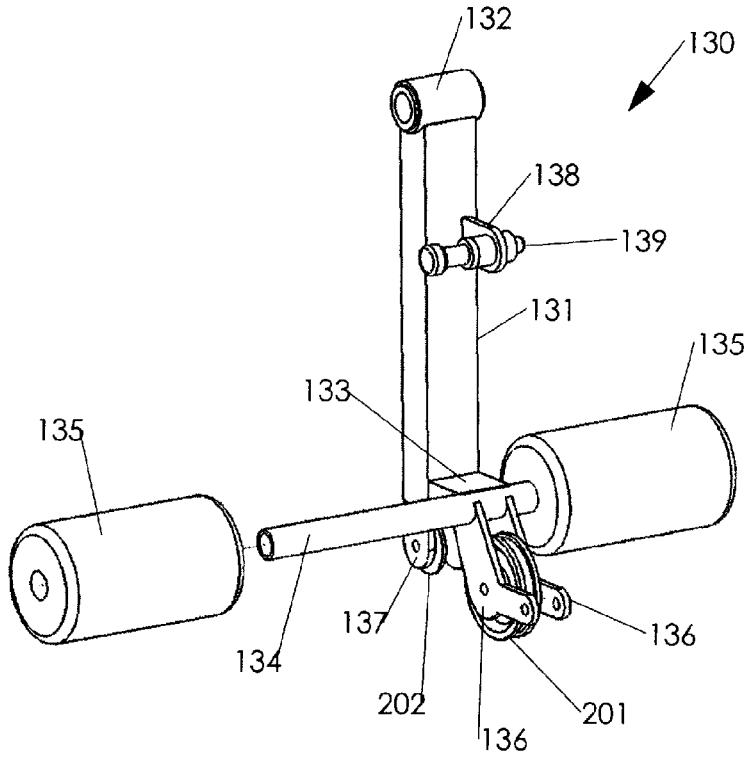
FIG. 12 is a perspective view illustrating an exemplary leg exercise arm assembly from the front right side.
Figure 12:
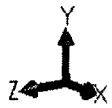

The exemplary leg exercise arm 130 is illustrated in FIG. 12 and includes extension tube 131 wherein bushing tube 132 is attached at the upper end, and bracket 137, which secures pulley 202 of cable and pulley system 200, is attached at the lower end. Lower pad extension tube 133 and lower pad tube 134 are attached near the lower end of extension tube 131 and secure lower pads 135. Pulley plates 136 are attached to lower pad extension tube 133 and lower pad tube 134 and secure pulley 201 of cable and pulley system 200. Locking pin 139 is attached to locking pin plate 138 which is attached to extension tube 131 and secures into aperture 152 of wrist roller assembly 150 into a first position for storage as best illustrated in FIG. 8.

Figure 9:
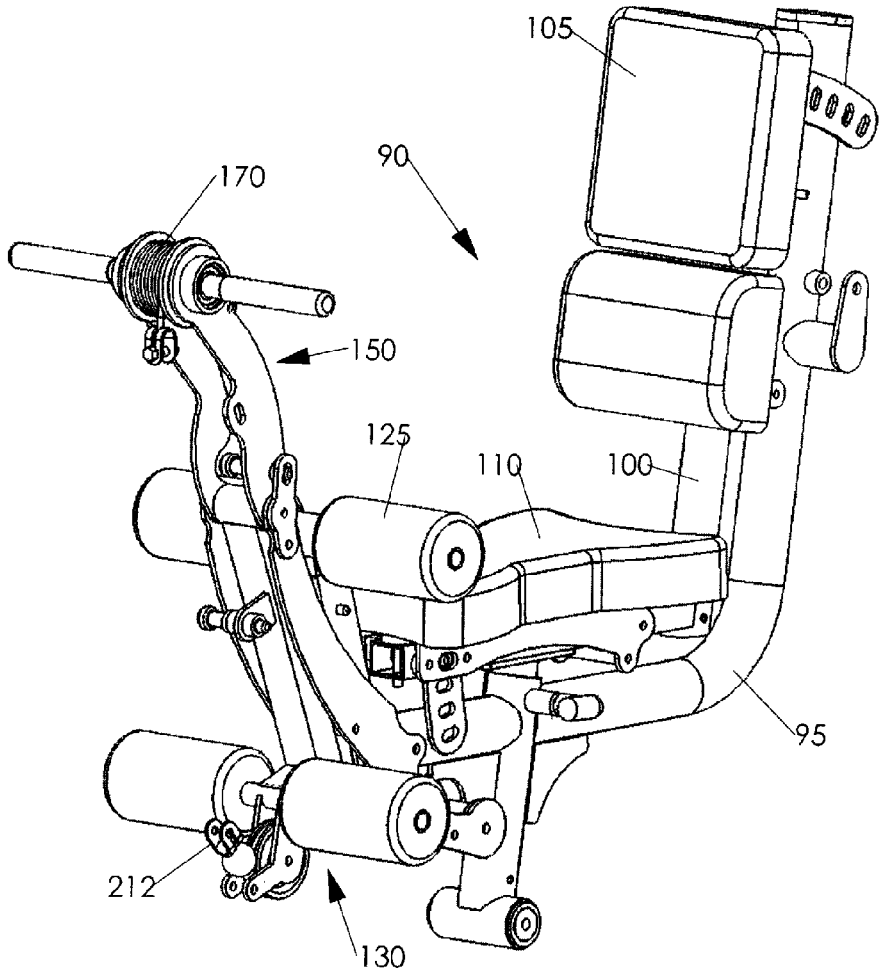
FIG. 9 is a perspective view illustrating an exemplary user support assembly from the front left side wherein the leg exercise arm assembly is in a start position and the wrist roller assembly is locked into a use second position.
Figure 9:
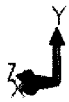
Figure 11:
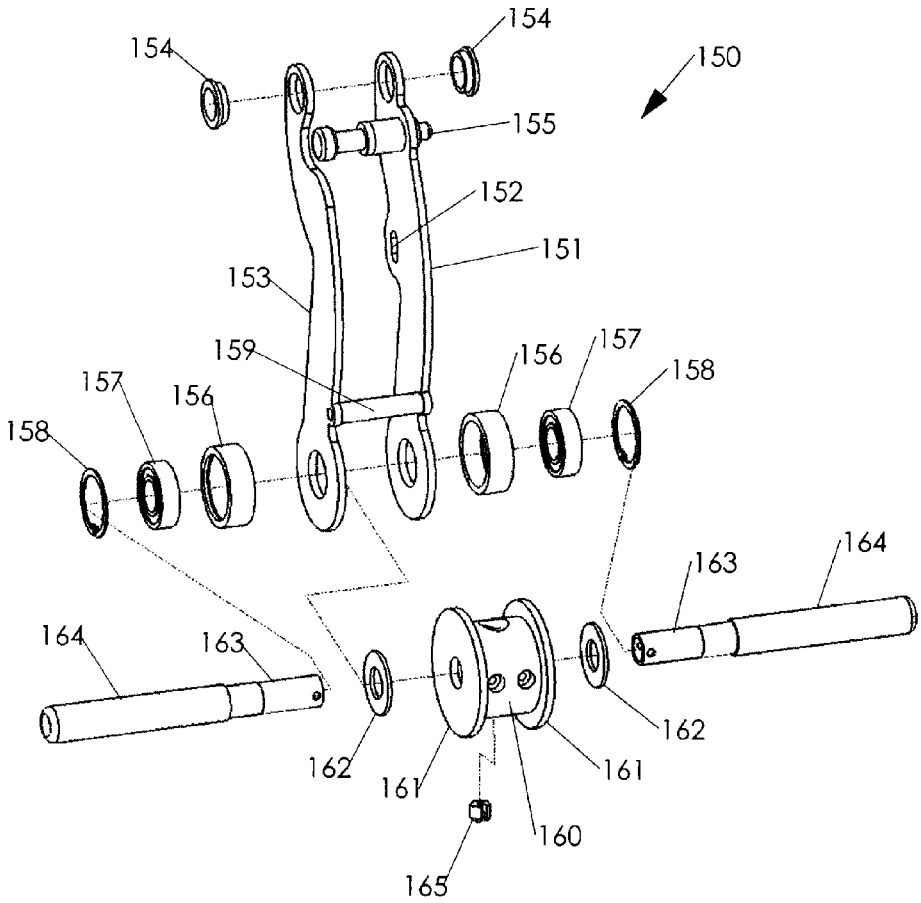
FIG. 11 is an exploded perspective view illustrating an exemplary wrist roller assembly from the front right side.
Figure 11:
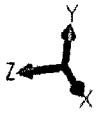

The exemplary wrist roller assembly 150 is illustrated in FIG. 11 and includes side plate 151 wherein bushing 154 is attached near one end and bearing sleeve 156 is attached near the other end. Bearing 157 fits into bearing sleeve 156 and is secured by snap ring 158. Locking pin 155 is attached to side plate 151 and locks into aperture plate 97 of seat main frame 95 and secures wrist roller assembly 150 into a second position for use as best illustrated in FIG. 9. Wrist roller assembly 150 further includes side plate 153 wherein bushing 154 is attached near one end and bearing sleeve 156 is attached near the other end. Bearing 157 fits into bearing sleeve 156 and is secured by snap ring 158. Spacer 159 attaches in between side plates 151 and 153 and provides proper spacing. Flexible line reel 160 fits in between side plates 151 and 153 and provides a surface for flexible line 170 to wrap around, wherein side plates 161 retain flexible line 170 as wrist rolling exercises are being performed. Flexible line 170 in a rolled up state of storage is best illustrated in FIG. 9. Flexible line reel 160 also includes an aperture for flexible line 170 to go through wherein retainer 165 secures flexible line 170. Respective handle bars 163 along with respective grips 164 go through respective bearings 157 of side plates 151 and 153, through respective bushings 162, and are secured inside of flexible line reel 160.

Figure 10:
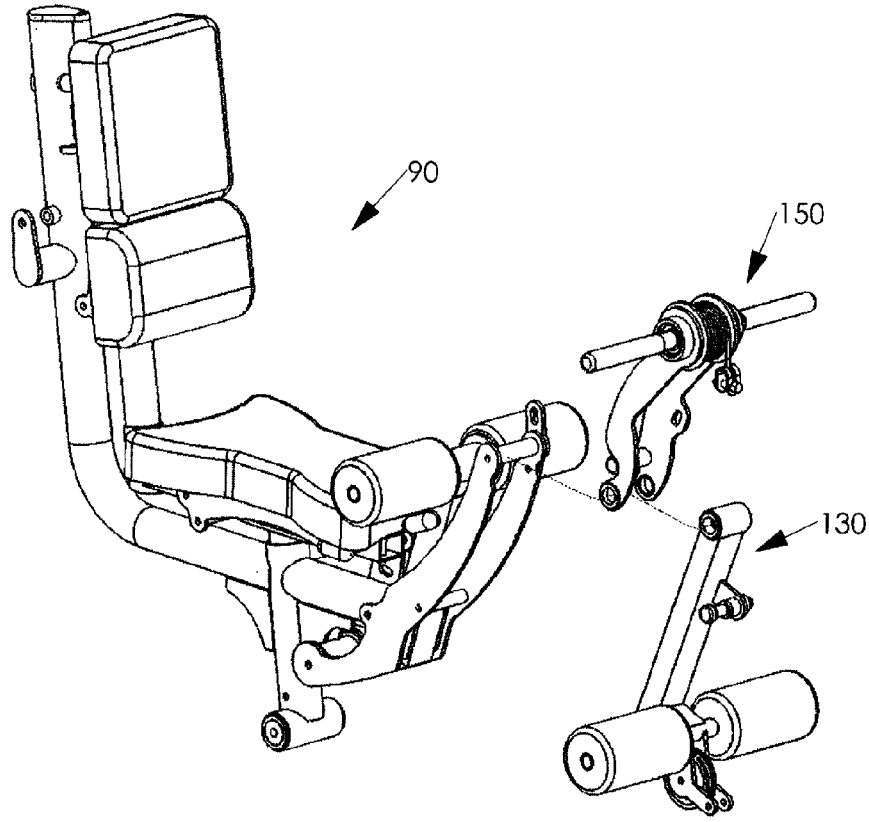
FIG. 10 is an exploded perspective view illustrating an exemplary user support assembly, a leg exercise arm assembly, and a wrist roller assembly from the front right side.
Figure 10:
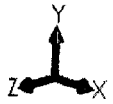

FIG. 10 is an exploded view illustrating the above mentioned exemplary leg exercise arm assembly 130 and exemplary wrist roller assembly 150 detached from the user support assembly 90.

FIG. 1 illustrates exercise apparatus 10 wherein the wrist roller assembly 150 is in a locked first position in storage. A user could exercise with arm assembly 50 to perform chest press exercises on exercise apparatus 10 without interference from the wrist roller assembly 150 while in this first position in storage. A user could exercise with the adjustable width high pull down assembly 75 to perform high pull down exercises on exercise apparatus 10 without interference from the wrist roller assembly 150 while in this first position in storage. A user could attach an abdominal crunch strap to mid section free cable end 211 and perform abdominal crunches on exercise apparatus 10 without interference from wrist roller assembly 150 while in this first position in storage. FIG.

8 also illustrates the user support assembly 90, the leg exercise arm assembly 130, and the wrist roller assembly 150 wherein the wrist roller assembly 150 is locked into the leg exercise arm assembly 130 into a first position in storage.

Figure 6:
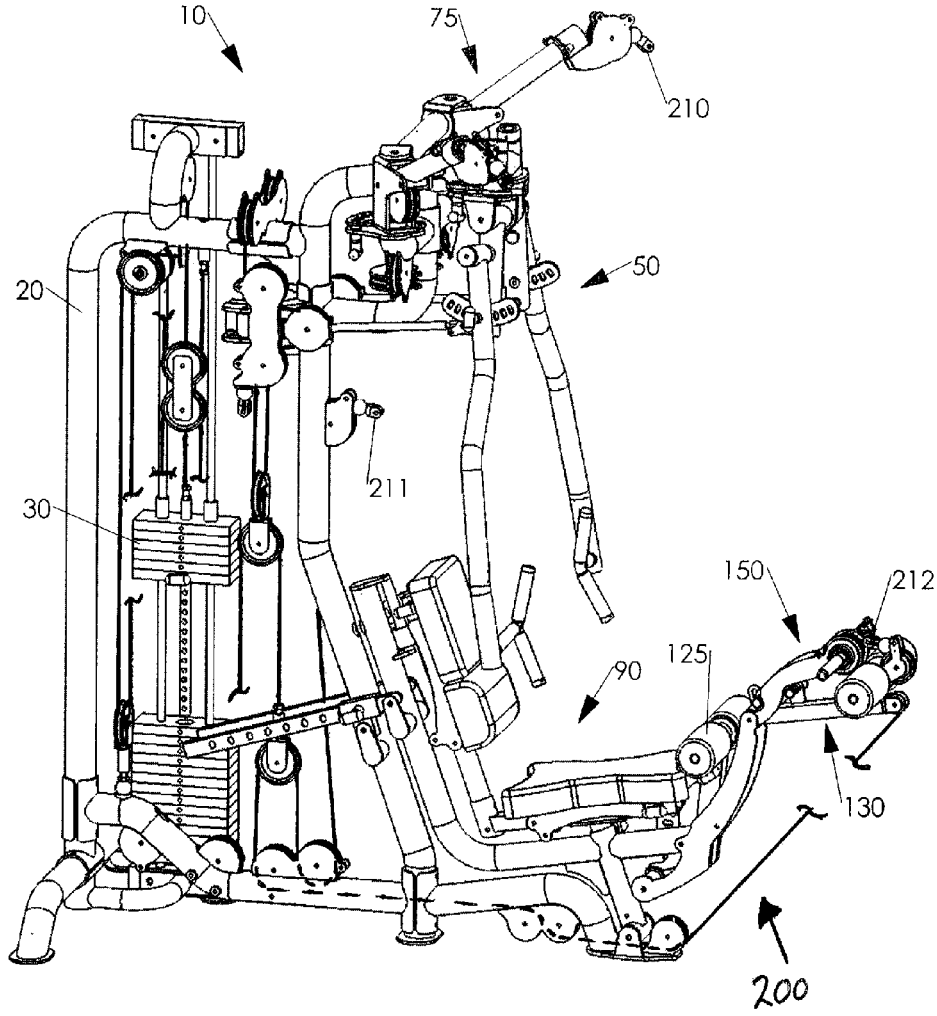
FIG. 6 is a perspective view illustrating an exemplary exercise apparatus from the front right side wherein the leg exercise arm assembly is in a finish position and the wrist roller assembly is locked into a storage first position.
Figure 6:
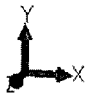

FIG. 6 illustrates exercise apparatus 10 wherein the wrist roller assembly 150 is in a locked first position in storage and wherein the leg exercise arm assembly 130 is in an extended finish position wherein a user would be performing a leg extension exercise. In this exemplary embodiment, the leg exercise arm assembly 130 and the wrist roller assembly 150 are both pivotally attached to the seat main frame 95 and share the same pivot axis, therefore the wrist roller assembly 150 pivots along with leg exercise arm assembly 130 during leg extension exercises. To perform leg extension exercise, the user would select the desired amount of resistance from weight stack 30, sit on user seat support 90, place their legs just underneath their knees over upper pad assembly 125, and their lower legs near their ankles behind lower pads 135 of leg exercise arm assembly 130. The user would then extend their legs back and forth for the desired number of repetitions. The wrist roller assembly 150 in this locked first position in storage does not interfere with the user's legs or feet during leg extension exercises.

Figure 7:
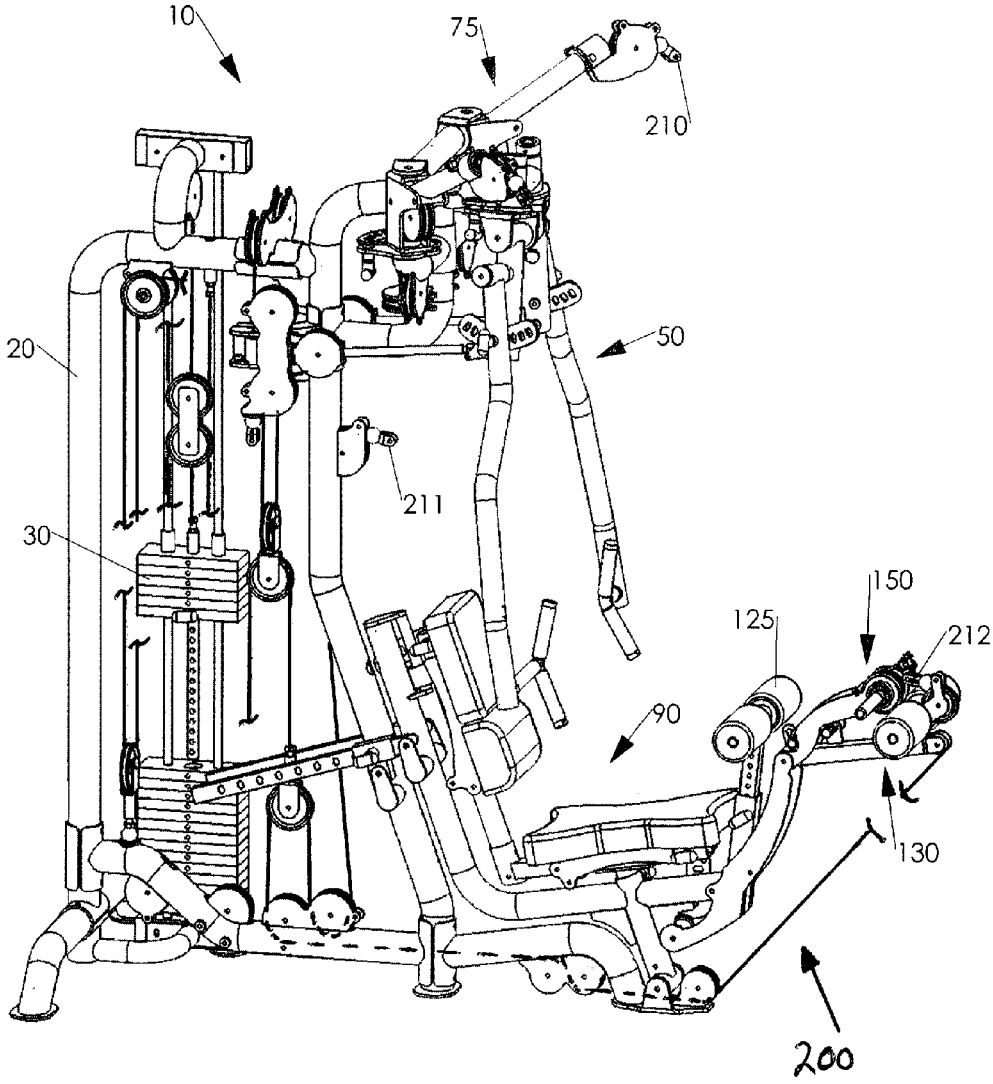
FIG. 7 is a perspective view illustrating an exemplary exercise apparatus from the front right side wherein the leg exercise arm assembly is in a finish position and the wrist roller assembly is locked into a storage first position.
Figure 7:
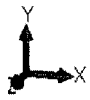

FIG. 7 illustrates exercise apparatus 10 wherein the wrist roller assembly 150 is in a locked first position in storage and wherein the leg exercise arm assembly 130 is in an extended finish position wherein a user would be performing a leg curl exercise. In this exemplary embodiment, the leg exercise arm assembly 130 and the wrist roller assembly 150 are both pivotally attached to the seat main frame 95 and share the same pivot axis, therefore the wrist roller assembly 150 pivots along with leg exercise arm assembly 130 during leg curl exercises. To perform leg curl exercise, the user would select the desired amount of resistance from weight stack 30, stand in front facing user support assembly 90, adjust the upper pad assembly 125 wherein the pads are above the pivot axis of leg exercise arm assembly 130 and wrist roller assembly 150, brace the front of one of their legs just above their knee against upper pad assembly 125, and brace the same leg near their ankle behind a respective lower pad 135 of leg exercise arm assembly 130. The user would then curl their leg back and forth for the desired number of repetitions. The wrist roller assembly 150 in this locked first position in storage does not interfere with the user's legs or feet during leg curl exercises. The user could lock wrist roller assembly 150 into a second position as shown in FIG. 9 and use the wrist roller as a brace to help stabilize the body while performing leg curl exercises. The wrist roller assembly 150 in this locked second position would not interfere with the user's legs or feet during leg curl exercises.

Figure 2:
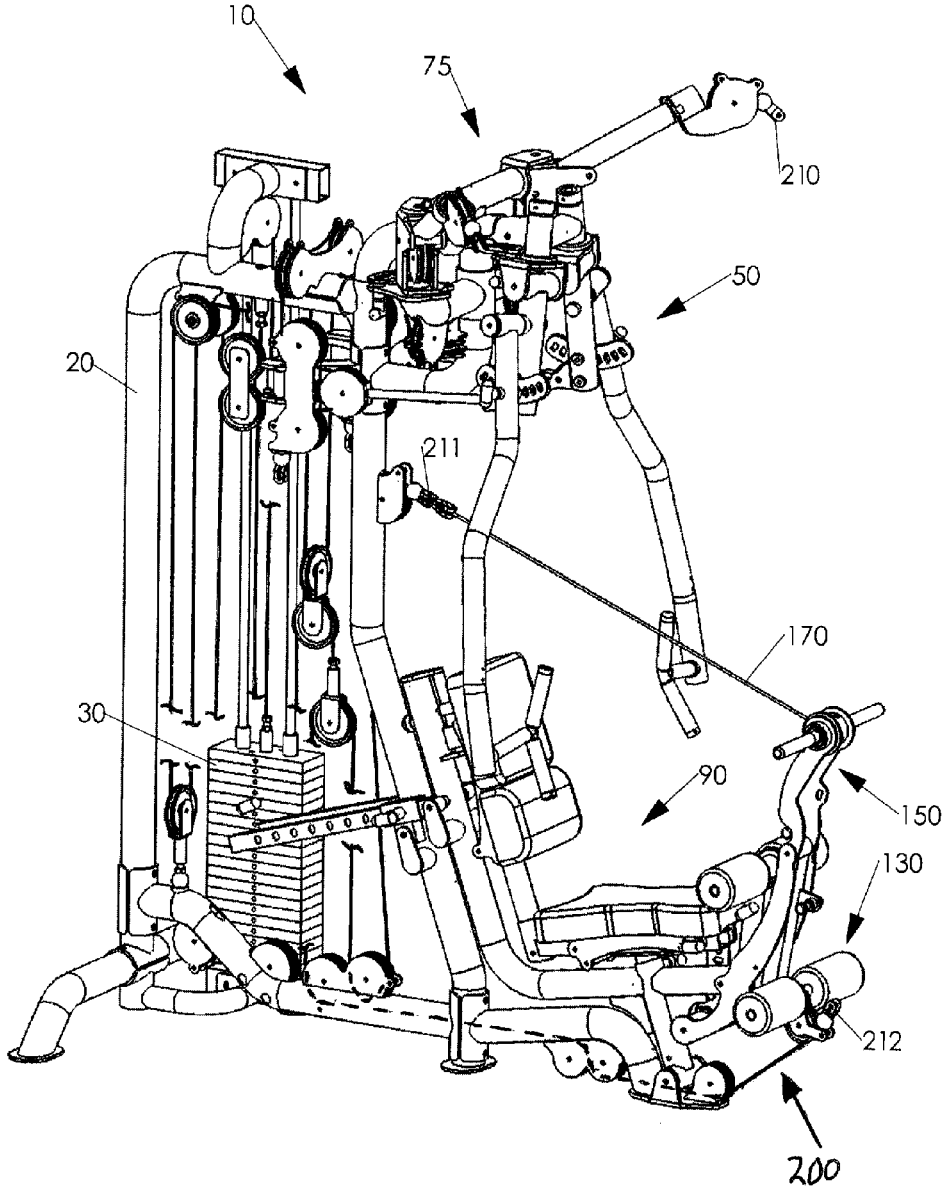
FIG. 2 is a perspective view illustrating an exemplary exercise apparatus from the front right side wherein the leg exercise arm assembly is in a start position and the wrist roller assembly is locked into a use second position with its flexible line attached to a mid pull station free flexible line end.
Figure 2:
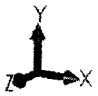
Figure 3:
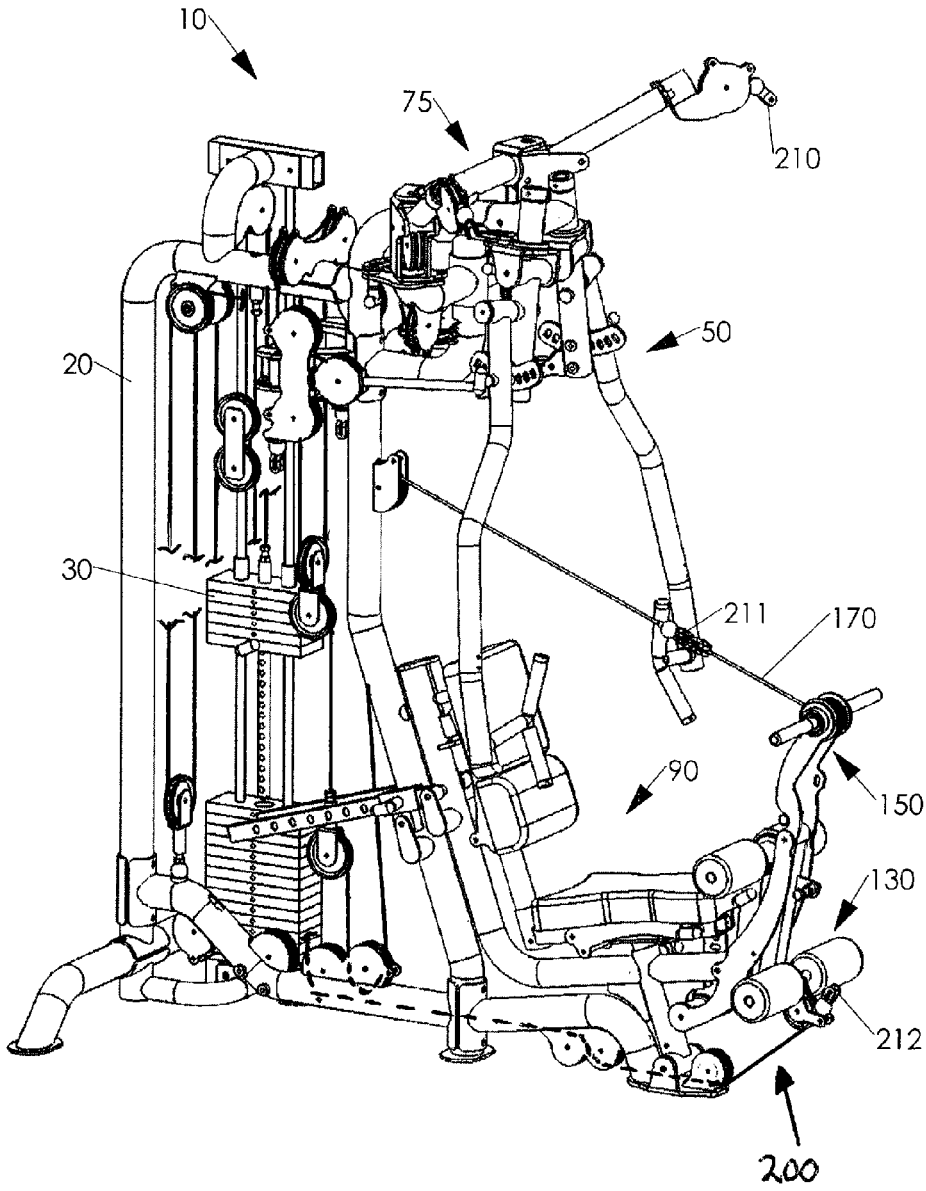
FIG. 3 is a perspective view illustrating an exemplary exercise apparatus from the front right side wherein the leg exercise arm assembly is in a start position and a partially wrapped wrist roller assembly is locked into a use second position with its flexible line attached to a mid pull station free flexible line end.
Figure 3:
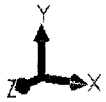

FIG. 2 illustrates exercise apparatus 10 wherein the wrist roller assembly 150 is in a locked second position in use. FIG. 9 also illustrates the user support assembly 90, the leg exercise arm assembly 130, and the wrist roller assembly 150 wherein the wrist roller assembly 150 is locked into the seat main frame 95 into a second position in use. As illustrated in FIG. 2, the free end of flexible line 170 of wrist roller assembly 150 is connected to mid section free cable end 211. This is the start position for performing wrist rolling exercises wherein a user has unwound flexible line 170 from wrist roller assembly 150 and selected the mid section free cable end to attach the free end of flexible line 170 based on the resistance ratio that mid section free cable end 211 is interconnected with the weight stack 30. Those skilled the art would appreciate that there are numerous resistance ratios that could be used by altering cable and pulley system 200 to interconnect a free cable end 211 to the resistance element 30. To perform wrist rolling exercise, the user would select the desired amount of resistance from weight stack 30 based on the ratio of resistance obtained when free cable end 211 is pulled. For example, the user could select a 10 pound weight from weight stack 30, however the mid section free cable end 211 could be interconnected to the weight stack 30 wherein the selected 10 pound plate would only provide 5 pounds of resistance when mid section free cable end 211 is pulled. The user would then stand in front of user support assembly 90 and grasp grips 164 on handle bars 163 and then begin to roll their wrists forwards or backwards, thus rotating flexible line reel 160 wherein flexible line 170 would wrap around flexible line reel 160 and would pull free cable end 211 of flexible line connecting system 200 and displace weight stack 30. FIG. 3 illustrates flexible line 170 partially wrapped around flexible line reel 160 wherein weight stack 30 is displaced. Once finished performing wrist rolling exercises, the user would detach flexible line 170 from mid section free cable end 211 and roll up flexible line 170 onto flexible line reel 160. The user would then unlock locking pin 155 of wrist roller assembly 150 and pivot wrist roller assembly 150 downward and lock it into the above described first position in storage wherein locking pin 139 of leg exercise arm assembly 130 secures wrist roller assembly 150 to the leg exercise arm assembly 130. When locked into the first position in storage, the wrist roller assembly 150 will not interfere with any other exercise movements or positions of the user on exercise apparatus 10.

Figure 4:
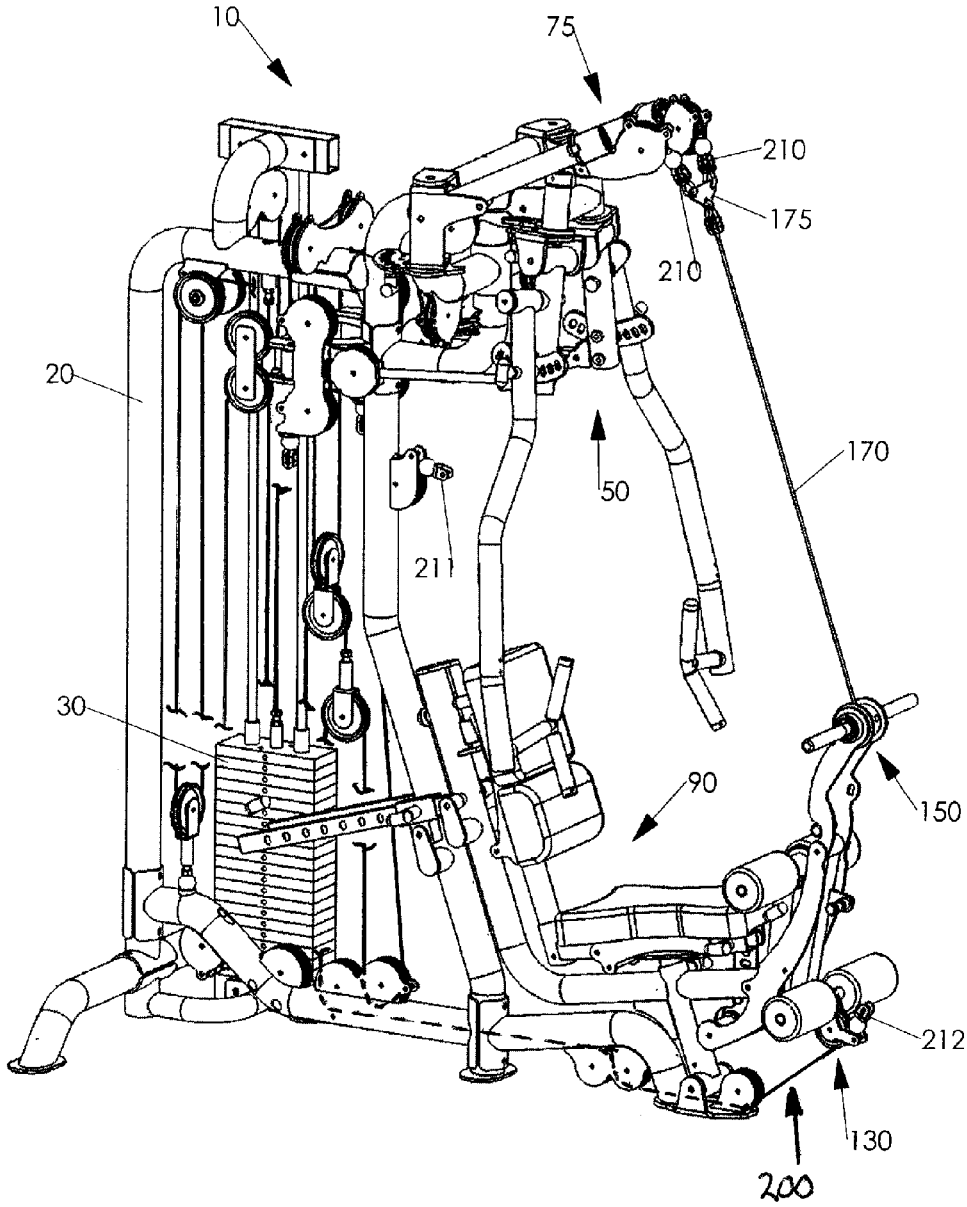
FIG. 4 is a perspective view illustrating an exemplary exercise apparatus from the front right side wherein the leg exercise arm assembly is in a start position and the wrist roller assembly is locked into a use second position with its flexible line attached to two high pull station free flexible line ends.
Figure 4:
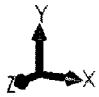

FIG. 4 illustrates exercise apparatus 10 wherein the wrist roller assembly 150 is in a locked second position in use. The free end of flexible line 170 of wrist roller assembly 150 is connected to high section free cable ends 210 with connector plate 175. This is the start position for performing wrist rolling exercises wherein a user has unwound flexible line 170 from wrist roller assembly 150 and selected the high section free cable ends 210 to attach the free end of flexible line 170 based on the resistance ratio that high section free cable ends 210 are interconnected with the weight stack 30. Those skilled the art would appreciate that there are numerous resistance ratios that could be used by altering cable and pulley system 200 to interconnect a free cable ends 210 to the resistance element 30. To perform wrist rolling exercise, the user would select the desired amount of resistance from weight stack 30 based on the ratio of resistance obtained when free cable ends 210 are pulled. The user would then stand in front of user support assembly 90 and grasp grips 164 on handle bars 163 and then begin to roll their wrists forwards or backwards, thus rotating flexible line reel 160 wherein flexible line 170 would wrap around flexible line reel 160 and would pull free cable ends 210 of flexible line connecting system 200 and displace weight stack 30. Once finished performing wrist rolling exercises, the user would detach flexible line 170 from high section free cable ends 210 and roll up flexible line 170 onto flexible line reel 160. The user would then unlock locking pin 155 of wrist roller assembly 150 and pivot wrist roller assembly 150 downward and lock it into the above described first position in storage wherein locking pin 139 of leg exercise arm assembly 130 secures wrist roller assembly 150 to the leg exercise arm assembly 130. When locked into the first position in storage, the wrist roller assembly 150 will not interfere with any other exercise movements or positions of the user on exercise apparatus 10.

Figure 5:
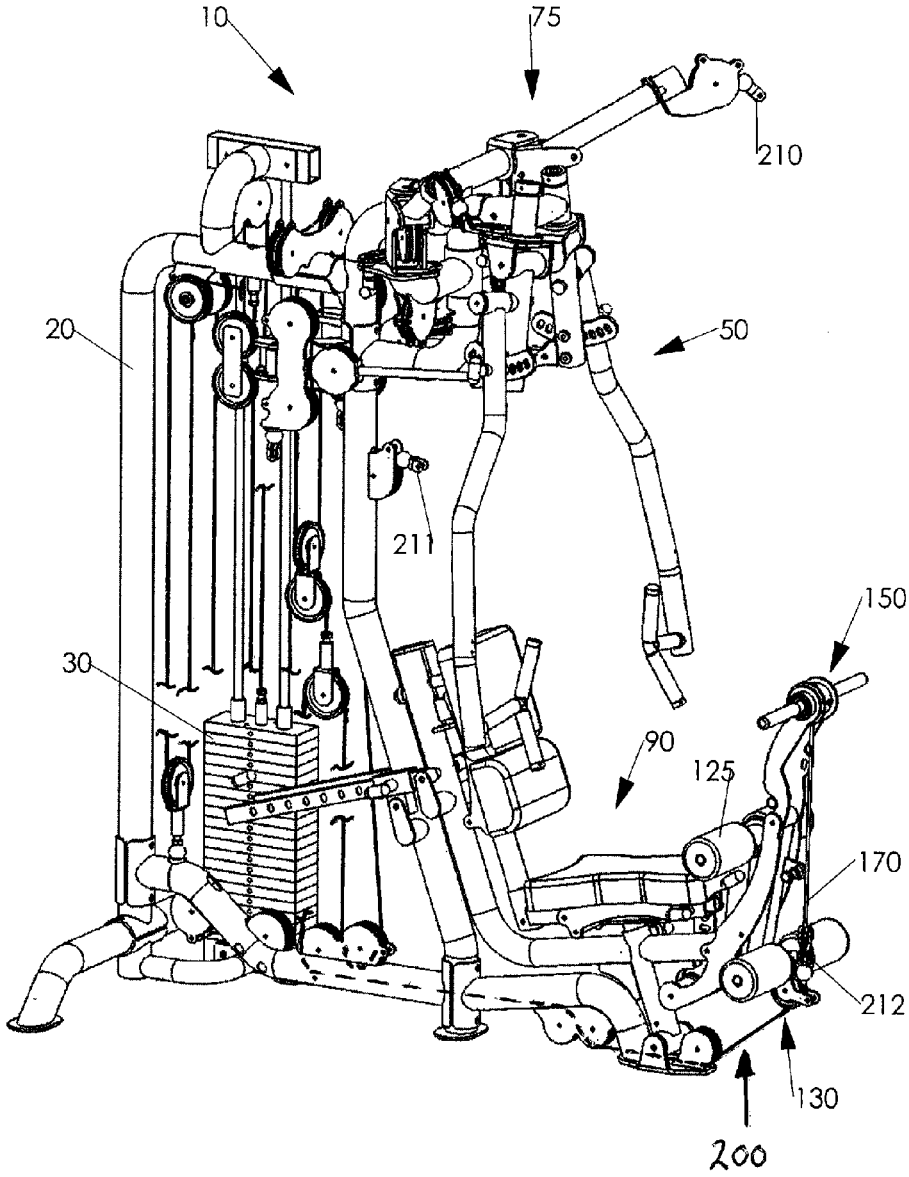
FIG. 5 is a perspective view illustrating an exemplary exercise apparatus from the front right side wherein the leg exercise arm assembly is in a start position and the wrist roller assembly is locked into a use second position with its flexible line attached to a low pull station free flexible line end.
Figure 5:
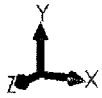

FIG. 5 illustrates exercise apparatus 10 wherein the wrist roller assembly 150 is in a locked second position in use. The free end of flexible line 170 of wrist roller assembly 150 is connected to low section free cable end 212. This is the start position for performing wrist rolling exercises wherein a user has unwound flexible line 170 from wrist roller assembly 150 and selected the low section free cable end 212 to attach the free end of flexible line 170 based on the resistance ratio that low section free cable end 212 is interconnected with the weight stack 30, as well as being able to perform wrist rolling exercise from a seated position if desired. Those skilled the art would appreciate that there are numerous resistance ratios that could be used by altering cable and pulley system 200 to interconnect a free cable end 212 to the resistance element 30. To perform wrist rolling exercise, the user would select the desired amount of resistance from weight stack 30 based on the ratio of resistance obtained when free cable end 212 is pulled. The user would then stand in front of user support assembly 90 or sit on user support assembly 90 and grasp grips 164 on handle bars 163 and then begin to roll their wrists forwards or backwards, thus rotating flexible line reel 160 wherein flexible line 170 would wrap around flexible line reel 160 and would pull free cable end 212 of flexible line connecting system 200 and displace weight stack 30. Once finished performing wrist rolling exercises, the user would detach flexible line 170 from low section free cable end 212 and roll up flexible line 170 onto flexible line reel 160. The user would then unlock locking pin 155 of wrist roller assembly 150 and pivot wrist roller assembly 150 downward and lock it into the above described first position in storage wherein locking pin 139 of leg exercise arm assembly 130 secures wrist roller assembly 150 to the leg exercise arm assembly 130. When locked into the first position in storage, the wrist roller assembly 150 will not interfere with any other exercise movements or positions of the user on exercise apparatus 10.

Figure 13:
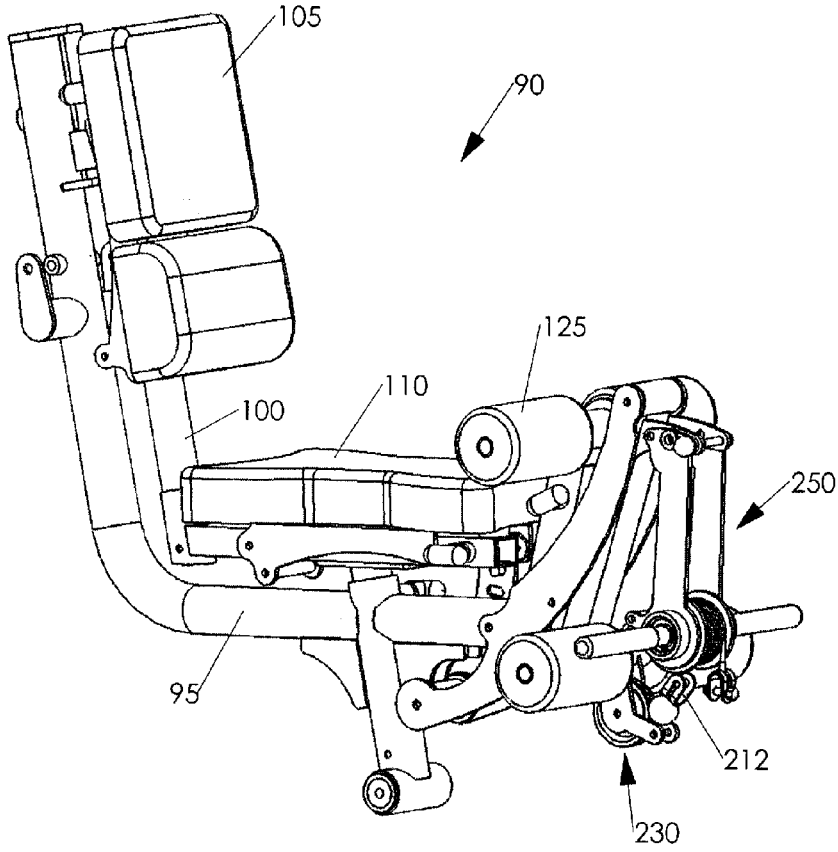
FIG. 13 is a perspective view illustrating an exemplary user support assembly from the front right side wherein an alternate embodiment leg exercise arm assembly is in a start position and an alternate embodiment wrist roller assembly is locked into a stored first position.
Figure 13:
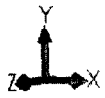

FIG. 13 illustrates the user support assembly 90, an alternate embodiment leg exercise arm assembly 230 pivotally attached to the user support assembly 90, and an alternate embodiment wrist roller assembly 250 pivotally attached and locked into the leg exercise arm assembly 230 into a first position in storage.

Figure 14:
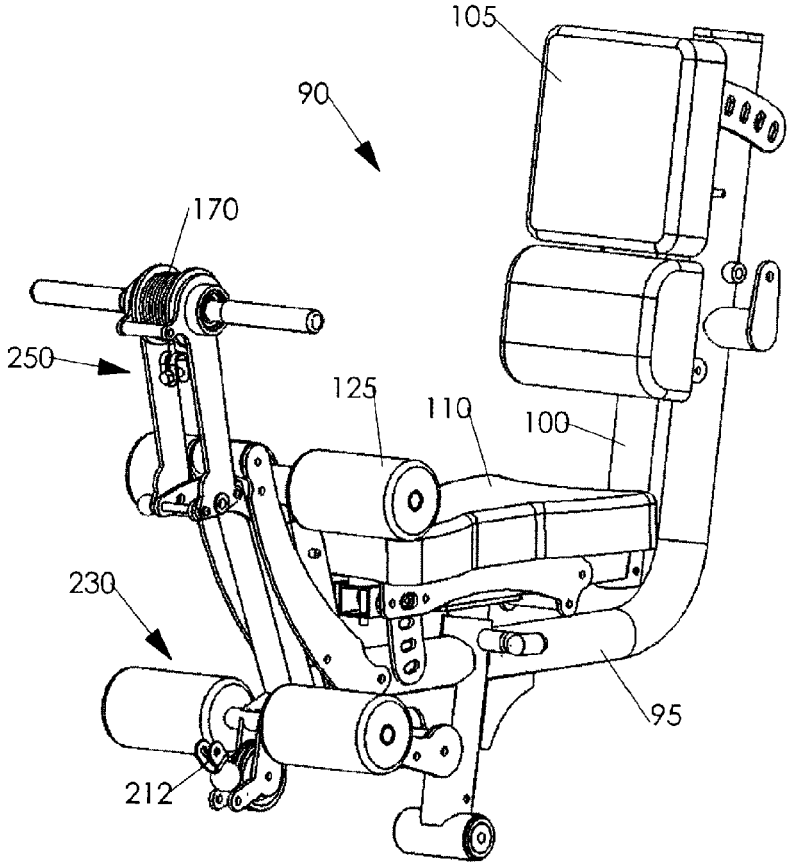
FIG. 14 is a perspective view illustrating an exemplary user support assembly from the front left side wherein an alternate embodiment leg exercise arm assembly is in a start position and an alternate embodiment wrist roller assembly is locked into a use second position.
Figure 14:
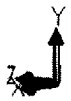

FIG. 14 illustrates the user support assembly 90, an alternate embodiment leg exercise arm assembly 230 pivotally attached to the user support assembly 90, and an alternate embodiment wrist roller assembly 250 pivotally attached and locked into the leg exercise arm assembly 230 into a second position in use.

Figure 17:
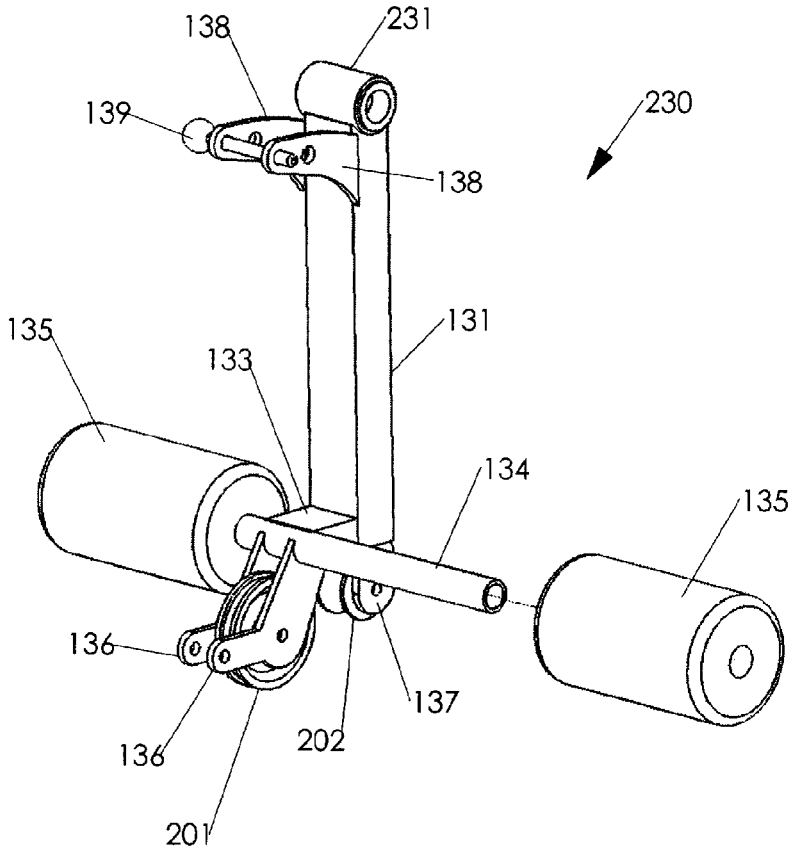
FIG. 17 is a perspective view illustrating an alternate embodiment leg exercise arm assembly from the front left side.
Figure 17:
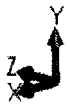

An alternate embodiment leg exercise arm 230 is illustrated in FIG. 17 and includes extension tube 131 wherein bushing tube 231 is attached at the upper end, and bracket 137, which secures pulley 202 of cable and pulley system 200, is attached at the lower end. Lower pad extension tube 133 and lower pad tube 134 are attached near the lower end of extension tube 131 and secure lower pads 135. Pulley plates 136 are attached to lower pad extension tube 133 and lower pad tube 134 and secure pulley 201 of cable and pulley system 200. Locking pin 139 goes through axis plates 138 which are attached near the upper end of extension tube 131 and also through apertures 252 of wrist roller assembly 250 and locks wrist roller assembly 250 into a first position for storage as best illustrated in FIG. 13. Locking pin 139 also goes through apertures 253 of wrist roller assembly 250 and locks wrist roller assembly 250 into a second position for use as best illustrated in FIG. 14.

Figure 16:
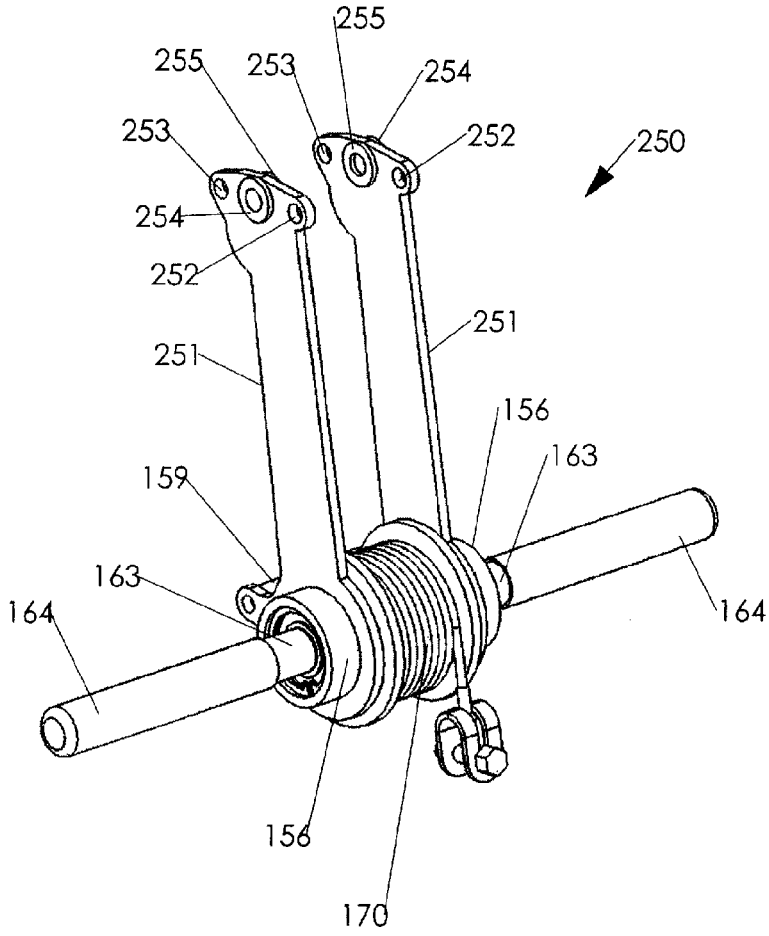
FIG. 16 is a perspective view illustrating an alternate embodiment wrist roller assembly from the front right side.
Figure 16:
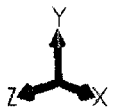

An alternate embodiment wrist roller assembly 250 is illustrated in FIG. 16 and includes side plates 251 wherein each side plate 251 includes bushings 254 and 255 attached near one end and a bearing sleeve 156 attached near the other end. Bearing 157 fits into bearing sleeve 156 and is secured by snap ring 158. Aperture 252 in side plate 251 is used by locking pin 139 of leg exercise arm assembly 230 to secure wrist roller assembly 250 into a first position in storage and aperture 253 in side plate 251 is used by locking pin 139 of leg exercise arm assembly 230 to secure wrist roller assembly 250 into a second position in use. Spacer 159 attaches in between side plates 251 and provides proper spacing. Flexible line reel 160 fits in between side plates 251 and provides a surface for flexible line 170 to wrap around as wrist rolling exercises are being performed. Flexible line reel 160 also includes an aperture for flexible line 170 to go through wherein retainer 165 secures flexible line 170. Respective handle bars 163 along with respective grips 164 go through respective bearings 157 of side plates 251, through respective bushings 162, and are secured inside of flexible line reel 160.

Figure 15:
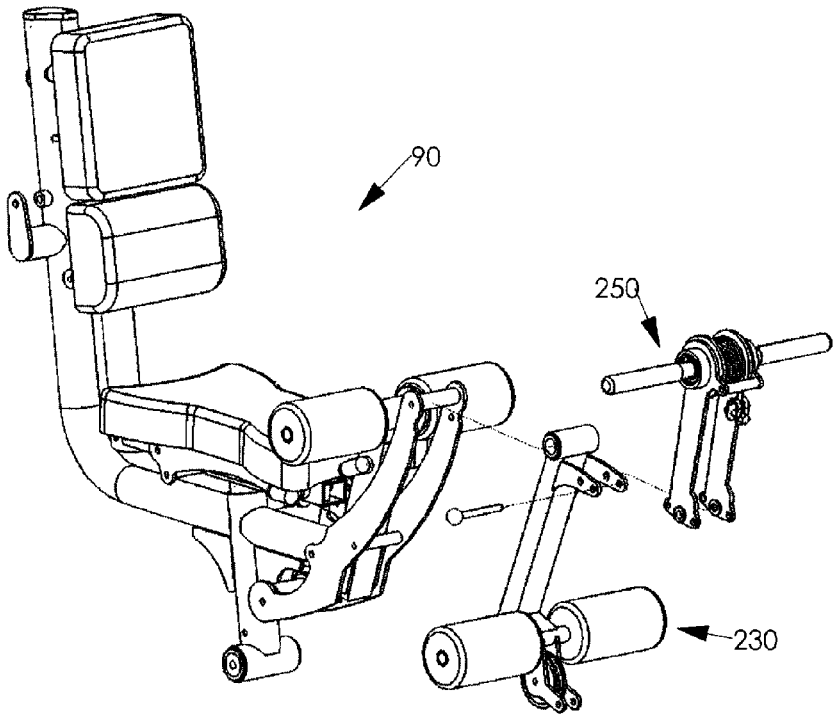
FIG. 15 is an exploded perspective view illustrating an exemplary user support assembly, an alternate embodiment leg exercise arm assembly, and an alternate embodiment wrist roller assembly from the front right side.
Figure 15:
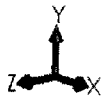

FIG. 15 is an exploded view illustrating the above mentioned alternate embodiment leg exercise arm assembly 230 and alternate embodiment wrist roller assembly 250 detached from the user support assembly 90.

Figure 18:
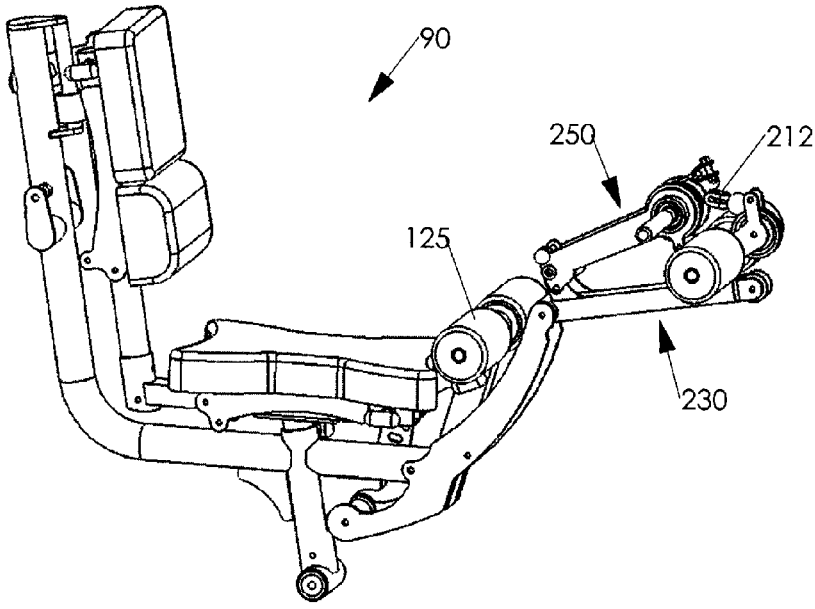
FIG. 18 is a perspective view illustrating an exemplary user support assembly from the front right side wherein an alternate embodiment leg exercise arm assembly is in a finish position and an alternate embodiment wrist roller assembly is in a stored first position.
Figure 18:
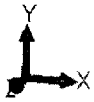

FIG. 18 illustrates user support assembly 90 wherein the wrist roller assembly 250 is in a locked first position in storage and wherein the leg exercise arm assembly 230 is in an extended finish position wherein a user would be performing a leg extension exercise. In this alternate embodiment, the leg exercise arm assembly 230 is pivotally attached to the user support assembly 90 and the wrist roller assembly 250 is pivotally attached to the leg exercise arm assembly 230, therefore the wrist roller assembly 250 moves along with leg exercise arm assembly 230 during leg extension exercises. To perform leg extension exercise, the user would select the desired amount of resistance from weight stack 30, sit on user seat support 90, place their legs just underneath their knees over upper pad assembly 125, and their lower legs near their ankles behind lower pads 135 of leg exercise arm assembly 230. The user would then extend their legs back and forth for the desired number of repetitions. The wrist roller assembly 250 in this locked first position in storage does not interfere with the user's legs or feet during leg extension exercises.

Figure 19:
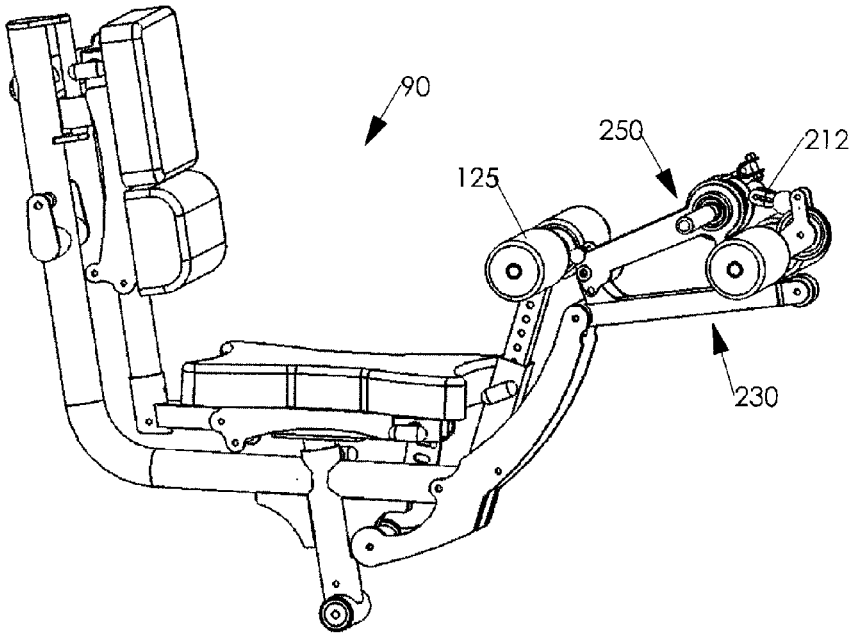
FIG. 19 is a perspective view illustrating an exemplary user support assembly from the front right side wherein an alternate embodiment leg exercise arm assembly is in a finish position and an alternate embodiment wrist roller assembly is in a stored first position.
Figure 19:
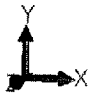

FIG. 19 illustrates user support assembly 90 wherein the wrist roller assembly 250 is in a locked first position in storage and wherein the leg exercise arm assembly 230 is in an extended finish position wherein a user would be performing a leg curl exercise. In this alternate embodiment, the leg exercise arm assembly 230 is pivotally attached to the user support assembly 90 and the wrist roller assembly 250 is pivotally attached to the leg exercise arm assembly 230, therefore the wrist roller assembly 250 moves along with leg exercise arm assembly 230 during leg curl exercises. To perform leg curl exercise, the user would select the desired amount of resistance from weight stack 30, stand in front facing user support assembly 90, adjust the upper pad assembly 125 wherein the pads are above the pivot axis of leg exercise arm assembly 230, brace the front of one of their legs just above their knee against upper pad assembly 125, and brace the same leg near their ankle behind a respective lower pad 135 of leg exercise arm assembly 230. The user would then curl their leg back and forth for the desired number of repetitions. The wrist roller assembly 250 in this locked first position in storage does not interfere with the user's legs or feet during leg curl exercises.

To perform wrist rolling exercise, the user would adjust and lock wrist roller assembly 250 into a use second position as illustrated in FIG. 14. As previously described in the exemplary embodiment, the user could attach one end of flexible line 170 to the high section free cable ends 210, the mid section free cable end 211, or the low section free cable end 212 and perform the previously described steps. Once finished performing wrist rolling exercises, the user can unlock locking pin 139 of leg exercise arm assembly 230 and pivot wrist roller assembly 250 downward and lock it into the above described first position in storage wherein locking pin 139 of leg exercise arm assembly 230 secures wrist roller assembly 250 to the leg exercise arm assembly 230 as illustrated in FIG. 13. When locked into the first position in storage, the wrist roller assembly 150 will not interfere with any other exercise movements or positions of the user on exercise apparatus 10.

Figure 26:
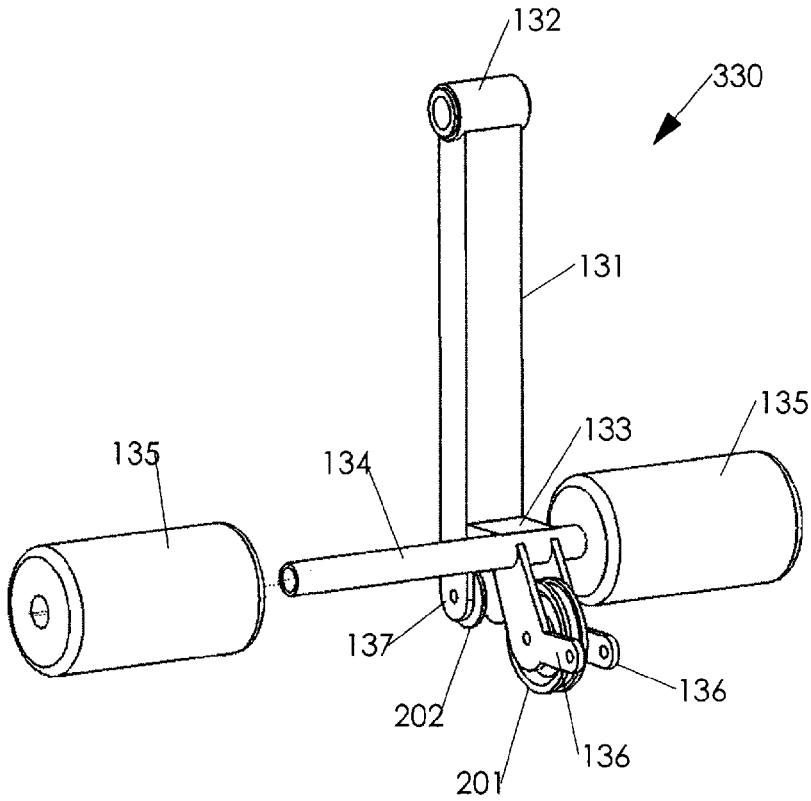
FIG. 26 is a perspective view illustrating a second alternate embodiment leg exercise arm assembly from the front right side.
Figure 26:
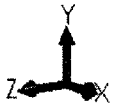

An alternate embodiment leg exercise arm assembly 330 is illustrated in FIG. 26 and includes extension tube 131 wherein bushing tube 132 is attached at the upper end, and bracket 137, which secures pulley 202 of cable and pulley system 200, is attached at the lower end. Lower pad extension tube 133 and lower pad tube 134 are attached near the lower end of extension tube 131 and secure lower pads 135. Pulley plates 136 are attached to lower pad extension tube 133 and lower pad tube 134 and secure pulley 201 of cable and pulley system 200.

Figure 20:
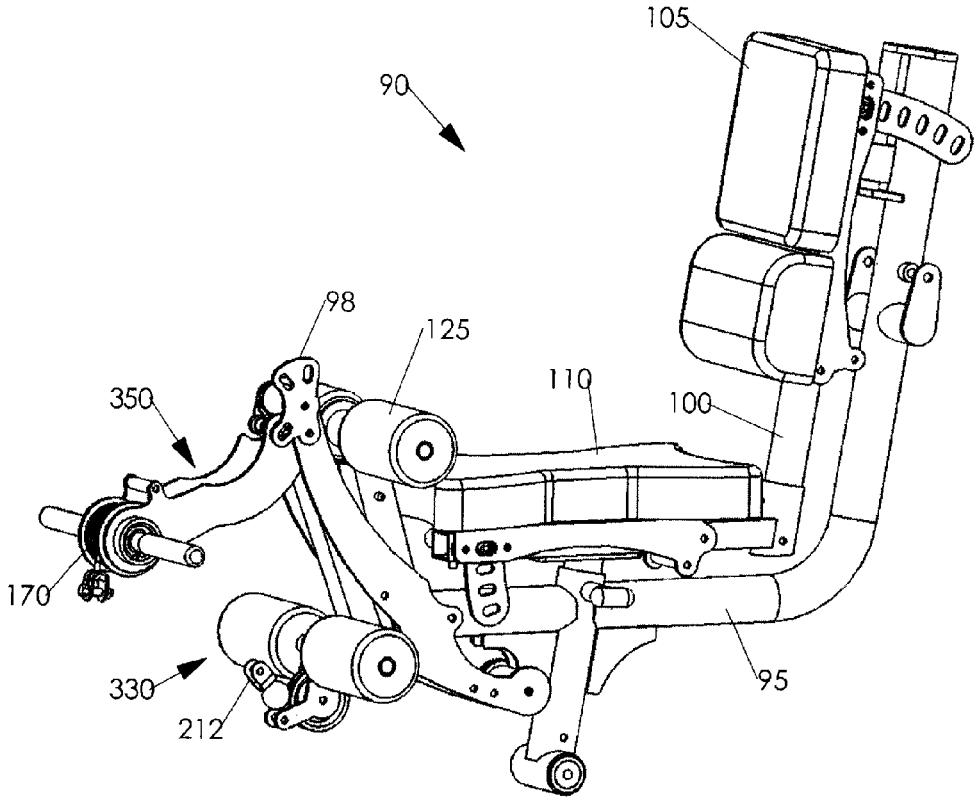
FIG. 20 is a perspective view illustrating an exemplary user support assembly with an alternate embodiment locking plate from the front left side wherein a second alternate embodiment leg exercise arm assembly is in a start position and second alternate embodiment wrist roller assembly is locked into a stored first position.
Figure 20:
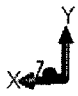
Figure 21:
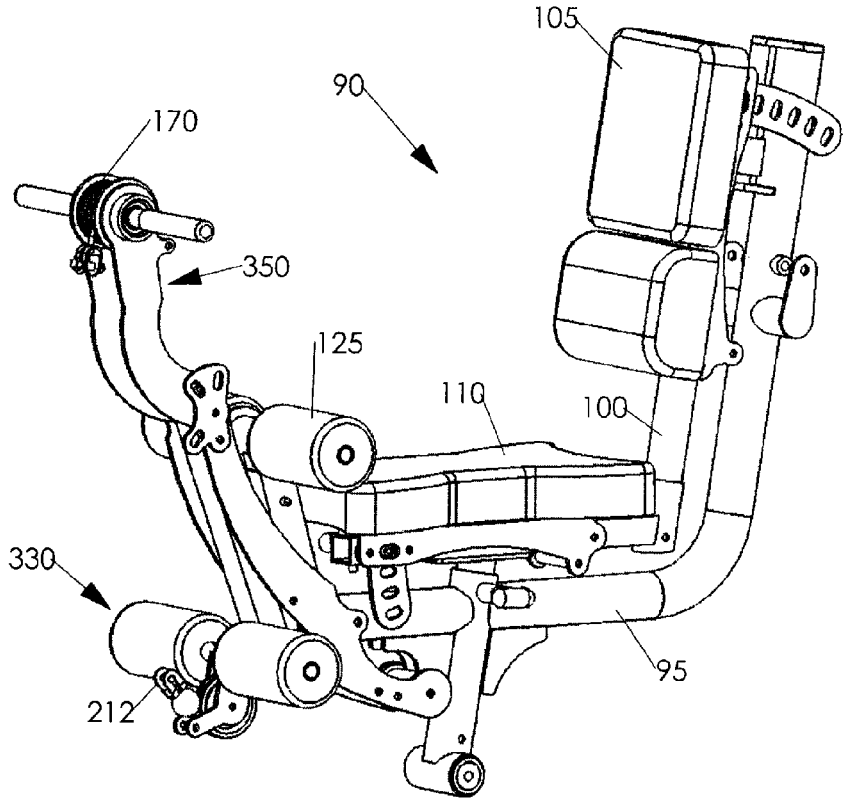
FIG. 21 is a perspective view illustrating an exemplary user support assembly with an alternate embodiment locking plate from the front left side wherein a second alternate embodiment leg exercise arm assembly is in a start position and a second alternate embodiment wrist roller assembly is in a use second position.
Figure 21:
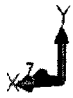
Figure 23:
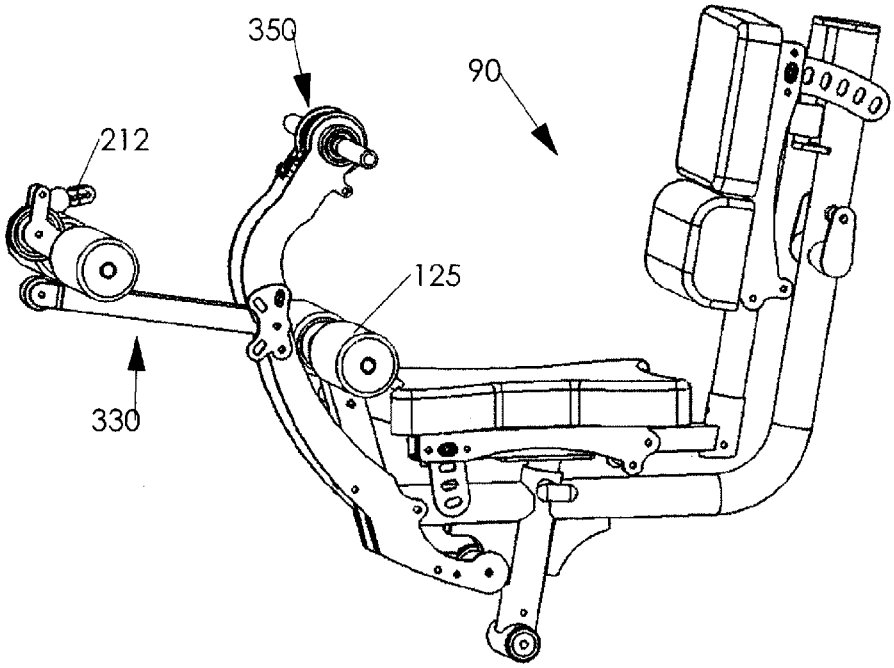
FIG. 23 is a perspective view illustrating an exemplary user support assembly with an alternate embodiment locking plate from the front left side wherein a second alternate embodiment leg exercise arm assembly is in a finish position and a second alternate embodiment wrist roller assembly is in a stored third position.
Figure 23:
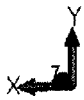
Figure 24:
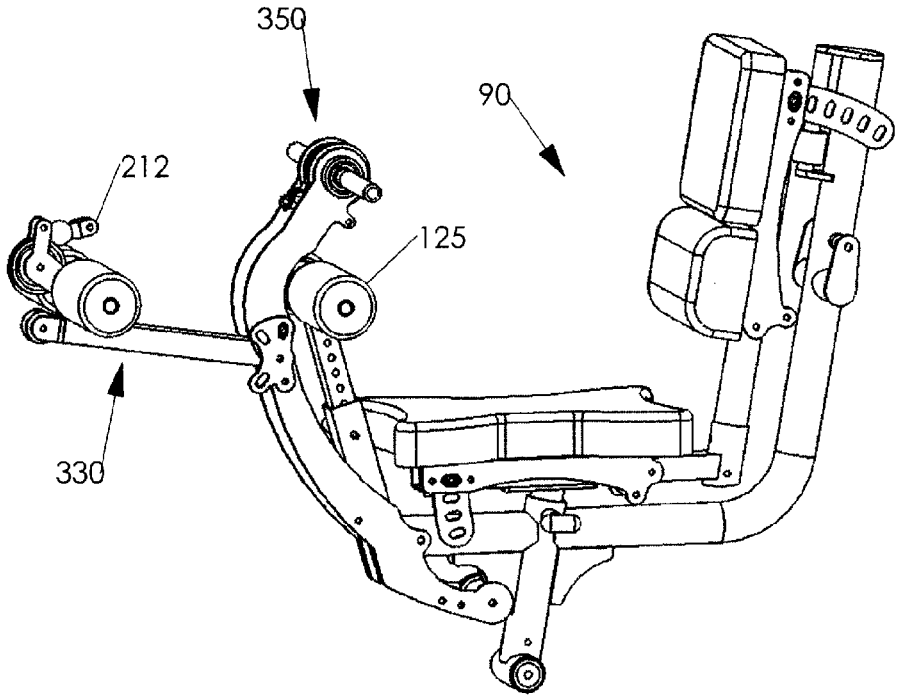
FIG. 24 is a perspective view illustrating an exemplary user support assembly with an alternate embodiment locking plate from the front left side wherein a second alternate embodiment leg exercise arm assembly is in a finish position and a second alternate embodiment wrist roller assembly is in a stored third position.
Figure 24:
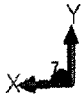
Figure 25:
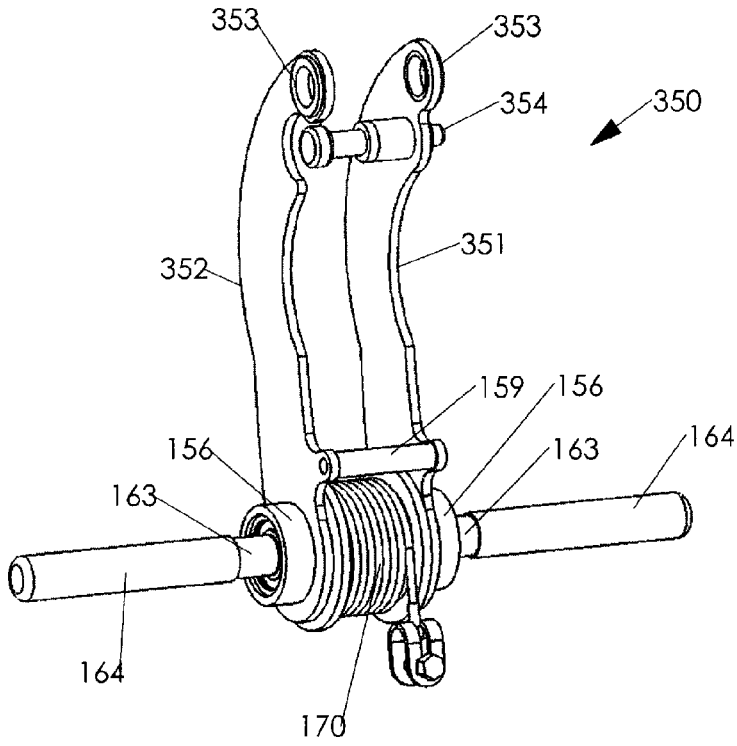
FIG. 25 is a perspective view illustrating a second alternate embodiment wrist roller assembly from the front right side.
Figure 25:
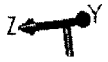

An alternate embodiment wrist roller assembly 350 is illustrated in FIG. 25 and includes side plate 351 wherein bushing 353 is attached near one end and bearing sleeve 156 is attached near the other end. Bearing 157 fits into bearing sleeve 156 and is secured by snap ring 158. Locking pin 354 is attached to side plate 351 and locks into aperture plate 98 of seat main frame 95 and secures wrist roller assembly 350 into a first position for storage as best illustrated in FIG. 20, a second position for use as best illustrated in FIG. 21, or a third position for storage when a user performs leg extension or leg curl exercises as best illustrated in FIGS. 23 and 24. Wrist roller assembly 350 further includes side plate 352 wherein bushing 353 is attached near one end and bearing sleeve 156 is attached near the other end. Bearing 157 fits into bearing sleeve 156 and is secured by snap ring 158. Spacer 159 attaches in between side plates 351 and 352 and provides proper spacing. Flexible line reel 160 fits in between side plates 351 and 352 and provides a surface for flexible line 170 to wrap around, wherein side plates 161 retain flexible line 170 as wrist rolling exercises are being performed. Flexible line reel 160 also includes an aperture for flexible line 170 to go through wherein retainer 165 secures flexible line 170. Respective handle bars 163 along with respective grips 164 go through respective bearings 157 of side plates 351 and 352, through respective bushings 162, and are secured inside of flexible line reel 160.

FIG. 20 illustrates alternate embodiment leg exercise arm assembly 330 and alternate embodiment wrist roller assembly 350 pivotally attached to the user support assembly 90. Seat main frame 95 includes aperture plate 98 wherein wrist roller assembly 350 is secured into a storage first position. This first position for storage is best suited for when a user performs chest presses, mid rows, abdominal crunches, and high pull downs as this position keeps the wrist roller assembly from interfering with these exercises.

FIG. 21 illustrates alternate embodiment leg exercise arm assembly 330 and alternate embodiment wrist roller assembly 350 pivotally attached to the user support assembly 90. Seat main frame 95 includes aperture plate 98 wherein wrist roller assembly 350 is secured into a use second position. Wrist rolling exercises can be performed in this second position of use. As previously described in the exemplary embodiment, the user could attach one end of flexible line 170 to the high section free cable ends 210, the mid section free cable end 211, or the low section free cable end 212 and perform the previously described steps. Once finished performing wrist rolling exercises, the user can unlock locking pin 354 of wrist roller assembly 350 and pivot wrist roller assembly 350 downward and lock it into the above described first position in storage wherein locking pin 354 of wrist roller assembly 350 locks into aperture plate 98. When locked into the first position in storage, the wrist roller assembly 350 will not interfere with chest press, mid row, abdominal crunch, or high pull exercise movements or positions of the user on exercise apparatus 10.

Figure 22:
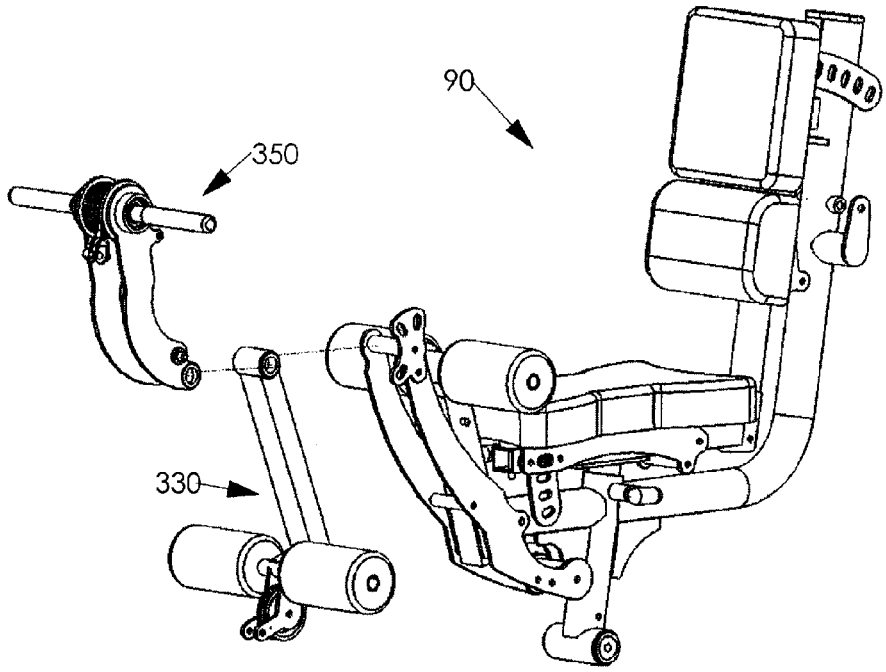
FIG. 22 is an exploded perspective view illustrating an exemplary user support assembly with an alternate embodiment locking plate, a second alternate embodiment leg exercise arm assembly, and a second alternate embodiment wrist roller assembly from the front left side.
Figure 22:
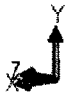

FIG. 22 is an exploded view illustrating alternate embodiment leg exercise arm assembly 330 and alternate embodiment wrist roller assembly 350 detached from the user support assembly 90.

FIG. 23 illustrates user support assembly 90 wherein the wrist roller assembly 350 is in a locked third position in storage and wherein the leg exercise arm assembly 330 is in an extended finish position wherein a user would be performing a leg extension exercise. Seat main frame 95 includes aperture plate 98 wherein wrist roller assembly 350 is secured into this storage third position thus allowing a user to perform leg extension exercises. To perform leg extension exercise, the user would select the desired amount of resistance from weight stack 30, sit on user seat support 90, place their legs just underneath their knees over upper pad assembly 125, and their lower legs near their ankles behind lower pads 135 of leg exercise arm assembly 330. The user would then extend their legs back and forth for the desired number of repetitions. The wrist roller assembly 350 in this locked third position in storage does not interfere with the user's legs or feet during leg extension exercises.

FIG. 24 illustrates user support assembly 90 wherein the wrist roller assembly 350 is in a locked third position in storage and wherein the leg exercise arm assembly 330 is in an extended finish position wherein a user would be performing a leg curl exercise. Seat main frame 95 includes aperture plate 98 wherein wrist roller assembly 350 is secured into this storage third position thus allowing a user to perform leg curl exercises. To perform leg curl exercise, the user would select the desired amount of resistance from weight stack 30, stand in front facing user support assembly 90, adjust the upper pad assembly 125 wherein the pads are above the pivot axis of leg exercise arm assembly 330, brace the front of one of their legs just above their knee against upper pad assembly 125, and brace the same leg near their ankle behind a respective lower pad 135 of leg exercise arm assembly 330. The user would then curl their leg back and forth for the desired number of repetitions. The wrist roller assembly 350 in this locked third position in storage does not interfere with the user's legs or feet during leg curl exercises.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An exercise apparatus comprising:

a frame;

at least one resistance element to provide resistance for performing exercise;

a leg exercise arm assembly, for performing at least one leg exercise, pivotally attached to said frame;

at least one exercise station including a flexible line end, said flexible line end connected directly or indirectly to said resistance element, wherein said resistance element is displaced when said flexible line end is pulled;

a wrist roller assembly, including a rotatable handle bar assembly for performing forearm exercise, pivotally attached to said frame or to said leg exercise arm assembly and movable between a first position engaged with said leg exercise arm and a second position engaged with said frame or said leg exercise arm assembly; and a flexible line wrapped around said rotatable handle bar assembly, wherein said flexible line can be unwrapped and attached to said flexible line end when said wrist roller assembly is in said second position, and wherein rotating said rotatable handle bar assembly will wrap said flexible line around said rotatable handle bar assembly, thus displacing said resistance element.

2. The exercise apparatus of claim 1 further comprising a user support assembly attached to said frame to support a user during exercise, wherein said leg exercise arm assembly and said wrist roller assembly are pivotally attached in front of said user support assembly.

3. The exercise apparatus of claim 2 wherein said leg exercise arm assembly and said wrist roller assembly are pivotally attached to said frame about the same axis.

4. The exercise apparatus of claim 3 wherein said rotatable handle bar assembly is positioned below said axis when said wrist roller assembly is in said first position engaged with said leg exercise arm assembly and positioned above said axis when said wrist roller assembly is in said second position engaged with said frame.

5. The exercise apparatus of claim 3 wherein said leg exercise arm assembly and said wrist roller assembly pivot together during leg extension exercises when said wrist roller assembly is engaged in said first position.

6. The exercise apparatus of claim 3 wherein said leg exercise arm assembly and said wrist roller assembly pivot together during standing leg curl exercises when said wrist roller assembly is engaged in said first position.

7. The exercise apparatus of claim 3 wherein said wrist roller assembly, in the second position, is positioned to serve as a brace to help to stabilize a user while performing standing leg curl exercises.

8. The exercise apparatus of claim 1 further comprising a second exercise station including a flexible line end directly or indirectly connected with said resistance element, wherein said flexible line end of said second exercise station provides an alternate ratio of resistance than said flexible line end of said first exercise station when pulled.

9. An exercise apparatus comprising:

a frame;

at least one resistance element to provide resistance for performing exercise;

a user support assembly, for supporting a user during exercise, pivotally attached to said frame;

a leg exercise arm assembly, for performing at least one leg exercise, pivotally attached to said user support assembly;

at least one exercise station including a flexible line end, said flexible line end connected directly or indirectly to said resistance element, wherein said resistance element is displaced when said flexible line end is pulled;

a wrist roller assembly, including a rotatable handle bar assembly for performing forearm exercise, pivotally attached to said user support assembly or to said leg exercise arm assembly and movable between a first position engaged with said leg exercise arm assembly and a second position engaged with said user support assembly or said leg exercise arm assembly; and a flexible line wrapped around said rotatable handle bar assembly, wherein said flexible line can be unwrapped and attached to said flexible line end when said wrist roller assembly is in said second position, and wherein rotating said rotatable handle bar assembly will wrap said flexible line around said rotatable handle bar assembly, thus displacing said resistance element.

10. The exercise apparatus of claim 9 wherein said leg exercise arm assembly and said wrist roller assembly are pivotally attached to said user support assembly about the same axis.

11. The exercise apparatus of claim 10 wherein said rotatable handle bar assembly is positioned below said axis when said wrist roller assembly is in said first position engaged with said leg exercise arm assembly and positioned above said axis when said wrist roller assembly is in said second position engaged with said user support assembly.

12. The exercise apparatus of claim 10 wherein said leg exercise arm assembly and said wrist roller assembly pivot together during leg extension exercises when said wrist roller assembly is engaged in said first position.

13. The exercise apparatus of claim 10 wherein said leg exercise arm assembly and said wrist roller assembly pivot together during standing leg curl exercises when said wrist roller assembly is engaged in said first position.

14. The exercise apparatus of claim 10 wherein said wrist roller assembly, in the second position, is positioned to serve as a brace to help to stabilize a user while performing standing leg curl exercises.

15. The exercise apparatus of claim 9 further comprising a second exercise station including a flexible line end directly or indirectly connected with said resistance element, wherein said flexible line end of said second exercise station provides an alternate ratio of resistance than said flexible line end of said first exercise station when pulled.

16. An exercise apparatus comprising:

a frame;

at least one resistance element to provide resistance for performing exercise;

a press exercise station for performing press exercises;

a user support assembly for supporting a user during exercise;

a leg exercise arm assembly, for performing at least one leg exercise, mounted in front of said user support assembly for pivotal movement;

at least one exercise station including a flexible line end, said flexible line end connected directly or indirectly to said resistance element, wherein said resistance element is displaced when said flexible line end is pulled;

a wrist roller assembly, including a rotatable handle bar assembly for performing forearm exercise, mounted in front of said user support assembly for pivotal movement, and movable between a first position out of the way when performing press exercises, and a second position for performing forearm exercise; and a flexible line wrapped around said rotatable handle bar assembly, wherein said flexible line can be unwrapped and attached to said flexible line end when said wrist roller assembly is in said second position, and wherein rotating said rotatable handle bar assembly will wrap said flexible line around said rotatable handle bar assembly, thus displacing said resistance element.

17. The exercise apparatus of claim 16 wherein said leg exercise arm assembly and said wrist roller assembly pivot about the same axis.

18. The exercise apparatus of claim 16 further comprising a second exercise station including a flexible line end directly or indirectly connected with said resistance element, wherein said flexible line end of said second exercise station provides an alternate ratio of resistance than said flexible line end of said first exercise station when pulled.

* * * * *